US007278538B2

(12) United States Patent
Chargueraud

(10) Patent No.: US 7,278,538 B2
(45) Date of Patent: Oct. 9, 2007

(54) BEVERAGE CARTON WITH STRAP TYPE CARRYING HANDLE

(75) Inventor: Vincent Chargueraud, Gond Pontouvre (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 417 days.

(21) Appl. No.: 10/836,153

(22) Filed: Apr. 30, 2004

(65) Prior Publication Data

US 2004/0262374 A1 Dec. 30, 2004

Related U.S. Application Data

(60) Division of application No. 10/084,746, filed on Feb. 25, 2002, now Pat. No. 6,758,337, and a continuation-in-part of application No. 09/795,617, filed on Feb. 28, 2001, now abandoned, which is a continuation-in-part of application No. 09/653,736, filed on Sep. 1, 2000, now abandoned, and a continuation of application No. PCT/US99/19883, filed on Aug. 30, 1999, which is a continuation of application No. PCT/US99/04551, filed on Mar. 2, 1999.

(30) Foreign Application Priority Data

| | | |
|---|---|---|
| Mar. 2, 1998 | (GB) | 9804301.1 |
| Aug. 28, 1998 | (GB) | 9818792.5 |
| Nov. 17, 1998 | (GB) | 9825122.6 |

(51) Int. Cl.
*B65D 75/00* (2006.01)

(52) U.S. Cl. ..... 206/147; 206/434; 206/155

(58) Field of Classification Search ..... 206/147, 206/194, 197, 434, 155; 229/117.22, 182.1, 229/155

See application file for complete search history.

(56) References Cited

U.S. PATENT DOCUMENTS

| | | | | |
|---|---|---|---|---|
| 1,141,789 | A | 6/1915 | Freese | 229/117.24 |
| 1,153,136 | A | 9/1915 | Rosenfeld | 229/117.22 |
| 2,028,085 | A | 1/1936 | Brunt | 229/117.22 |
| 2,324,771 | A * | 7/1943 | Flore | 206/189 |
| 2,405,517 | A | 8/1946 | Plummer | |
| 2,563,065 | A * | 8/1951 | Price | 206/171 |
| 2,645,407 | A | 7/1953 | Bergstein | 229/117.24 |
| 2,662,684 | A | 12/1953 | Robins | 229/117.13 |
| 2,760,716 | A | 8/1956 | Weiner | |
| 2,795,367 | A | 6/1957 | Feldman | 229/117.12 |
| 2,817,473 | A * | 12/1957 | Foster | 206/149 |
| 2,982,400 | A | 5/1961 | Andre | 206/142 |
| 3,094,268 | A | 6/1963 | Swanson et al. | 206/141 |
| 3,112,856 | A | 12/1963 | MacIntosh et al. | 229/117.12 |
| 3,168,194 | A * | 2/1965 | Weiss | 206/155 |

(Continued)

FOREIGN PATENT DOCUMENTS

| | | |
|---|---|---|
| CA | 1 243 987 | 11/1988 |

(Continued)

*Primary Examiner*—David T. Fidei
(74) *Attorney, Agent, or Firm*—Tsugihiko Suzuki

(57) ABSTRACT

A tubular carton and blank for forming the carton includes a top, base and a pair of side walls. At least one of the side walls includes a displaceable zone arranged to protrude out of the plane of the one side wall. The displaceable zone includes connected sections each occupying a different plane to a next adjacent section.

8 Claims, 21 Drawing Sheets

U.S. PATENT DOCUMENTS

| | | | | | |
|---|---|---|---|---|---|
| 3,207,303 | A | | 9/1965 | Breedveid | 206/426 |
| RE25,949 | E | | 12/1965 | Andre | 206/142 |
| 3,300,119 | A | | 1/1967 | Chaussadas | 206/141 |
| 3,315,876 | A | | 4/1967 | Vander Jagt | 229/117.22 |
| D208,012 | S | | 6/1967 | Gale | D58/26 |
| 3,348,672 | A | * | 10/1967 | Brown | 206/197 |
| 3,353,709 | A | | 11/1967 | Lawrence | 206/141 |
| 3,640,448 | A | | 2/1972 | Wood | 206/158 |
| 3,777,883 | A | * | 12/1973 | Hackenberg | 206/780 |
| 3,801,012 | A | | 4/1974 | Theien | 428/340 |
| 3,891,084 | A | | 6/1975 | Elizondo-Garcia | 206/143 |
| 3,929,274 | A | | 12/1975 | Akkerman | 229/117.12 |
| 4,166,570 | A | | 9/1979 | Lazerand | 229/52 B |
| 4,295,598 | A | | 10/1981 | Calvert | 206/428 X |
| 4,374,562 | A | | 2/1983 | Oliff | 206/434 |
| 4,397,393 | A | * | 8/1983 | Pergande et al. | 206/549 |
| 4,437,606 | A | * | 3/1984 | Graser | 206/155 |
| 4,470,503 | A | | 9/1984 | Stone | 206/141 |
| 4,498,619 | A | | 2/1985 | Roccaforte | |
| 4,588,084 | A | | 5/1986 | Holley, Jr. | 206/427 |
| 4,747,534 | A | | 5/1988 | Marie | 206/141 |
| 4,784,266 | A | | 11/1988 | Chaussadas | 206/434 |
| 4,860,944 | A | | 8/1989 | Wonnacott | 229/52 B |
| 4,905,888 | A | | 3/1990 | Suoss | 229/117.22 |
| 5,328,081 | A | | 7/1994 | Saulas | 229/117.12 |
| 5,595,292 | A | | 1/1997 | Bates | 206/158 |
| 5,669,500 | A | | 9/1997 | Sutherland | 206/427 |
| 5,704,540 | A | | 1/1998 | Coalier | 229/117.26 |
| 5,775,570 | A | * | 7/1998 | Kim | 229/4.5 |
| 5,819,920 | A | | 10/1998 | Sutherland | 206/194 |
| 5,878,877 | A | | 3/1999 | Sutherland | 206/167 |
| 5,878,946 | A | | 3/1999 | Frerot et al. | 229/117.13 |
| 5,992,733 | A | | 11/1999 | Gomes | 229/117.26 |
| 6,065,590 | A | | 5/2000 | Spivey | 206/141 |
| 6,425,520 | B1 | * | 7/2002 | Peterson | 229/117.13 |

FOREIGN PATENT DOCUMENTS

| | | | |
|---|---|---|---|
| CH | 536 757 | | 6/1973 |
| DE | 79 01 421 | | 4/1979 |
| DE | 30 21 772 | | 1/1981 |
| DE | 3200984 | A1 | 9/1982 |
| EP | 0 473 266 | | 3/1992 |
| EP | 0 754 631 | | 1/1997 |
| FR | 1 447 790 | | 10/1966 |
| GB | 825 971 | | 12/1959 |
| GB | 2186550 | A | 8/1987 |
| GB | 2200893 | A | 8/1988 |
| GB | 2202516 | A | 9/1988 |
| GB | 2206564 | A | 1/1989 |
| GB | 2206565 | A | 1/1989 |
| GB | 2234495 | A | 2/1991 |
| GB | 2 252 958 | A | 8/1992 |
| GB | 2252548 | A | 8/1992 |
| JP | 58-55068 | | 4/1983 |
| WO | 96/01770 | | 1/1996 |
| WO | 96/20874 | | 7/1996 |
| WO | 97/07031 | | 2/1997 |

* cited by examiner

BEVERAGE CARTON WITH STRAP TYPE CARRYING HANDLE

This is a division of application Ser. No. 10/084,746 filed Feb. 25, 2002, now U.S. Pat. No. 6,758,337 which is a continuation-in-part of application Ser. No. 09/653,736 now abandoned and Ser. No. 09/795,617 now abandoned filed Sep. 1, 2000 and Feb. 28, 2001 respectively, which in turn are continuations of international application Nos. PCT/US99/04551 and PCT/US99/19883, filed Mar. 2, 1999 and Aug. 30, 1999 respectively, which are hereby incorporated by reference.

BACKGROUND OF THE INVENTION

This invention relates to a carton which is particularly but not only suitable for accommodating beverage containers such as cans and which incorporates a "strap-type" carrying handle which is automatically set up into a position of use as the carton is being closed after having been loaded.

Beverage cartons which include carrying handles and indeed, strap type carrying handles are known. For example, U.S. Pat. No. 4,166,570 (Lazerand et al) discloses a packaging carton for beverage cans which has a strap type handle. The handle strap has a central user portion exposed to view in a handle access aperture in top wall of the carton, extends across the top wall and has opposite ends which terminate in respective ones of a pair of end closure flaps which are hinged to the top wall. The handle strap is reinforced by a separate strip of reinforcing material, for example, a fibrous tape.

WO 97/07031 (Riverwood International Corporation) discloses a packaging carton for beverage cans having a handle strap secured at each end thereof to an outer face of an end closure panel of the carton between a pair of cuts which extend across the hinge between the top panel and the respective end closure panel. As the carton is lifted via the handle, the provision of a fold line extending between the pairs of cuts on the top panel allows the portions bounded by the cut lines to deflect inwardly.

SUMMARY OF THE INVENTION

The present invention has sought to overcome or at least mitigate the problems of the prior art.

The present invention provides a carton for holding an article or articles. The carton comprises top, opposed side walls and a base, hingedly interconnected to form a tubular structure. At least one of the side walls comprises a displaceable zone arranged to protrude out of the plane of the one side wall to accommodate a portion of an adjacent article. The displaceable zone comprises a plurality of connected sections each occupying a different plane to a next adjacent section.

According to an optional feature of the invention, the connected sections are defined by a series of pairs of arcuate cut lines.

According to another optional feature of the invention, the one side wall further comprises an article support panel struck from a portion of the one side wall. Arcuate cut lines are formed in the article support panel to define the connected sections. The cut lines are arranged in a substantially vertical plane.

According to a further optional feature of the invention, the carton further comprises at least one article engaging reinforcing flap folded inwardly of one of the side panels to retain a lower portion of an article.

The invention in a second aspect provides a carton blank for forming a carton for packaging an article or articles each having a shaped body portion, for example a pear shaped bottle. The carton blank comprises a top, opposed side walls and a base hingedly interconnected together. At least one of the side walls comprises a plurality of arcuate cut lines arranged in a spaced relationship to form a displaceable zone for accommodating the shaped body portion of an article when the carton is in a set up condition.

BRIEF DESCRIPTION OF THE DRAWINGS

Embodiments of the invention will now be described, by way of example only, with reference to the following drawings in which.

DETAILED DESCRIPTION OF THE PREFERRED EMBODIMENTS

Figure 1:
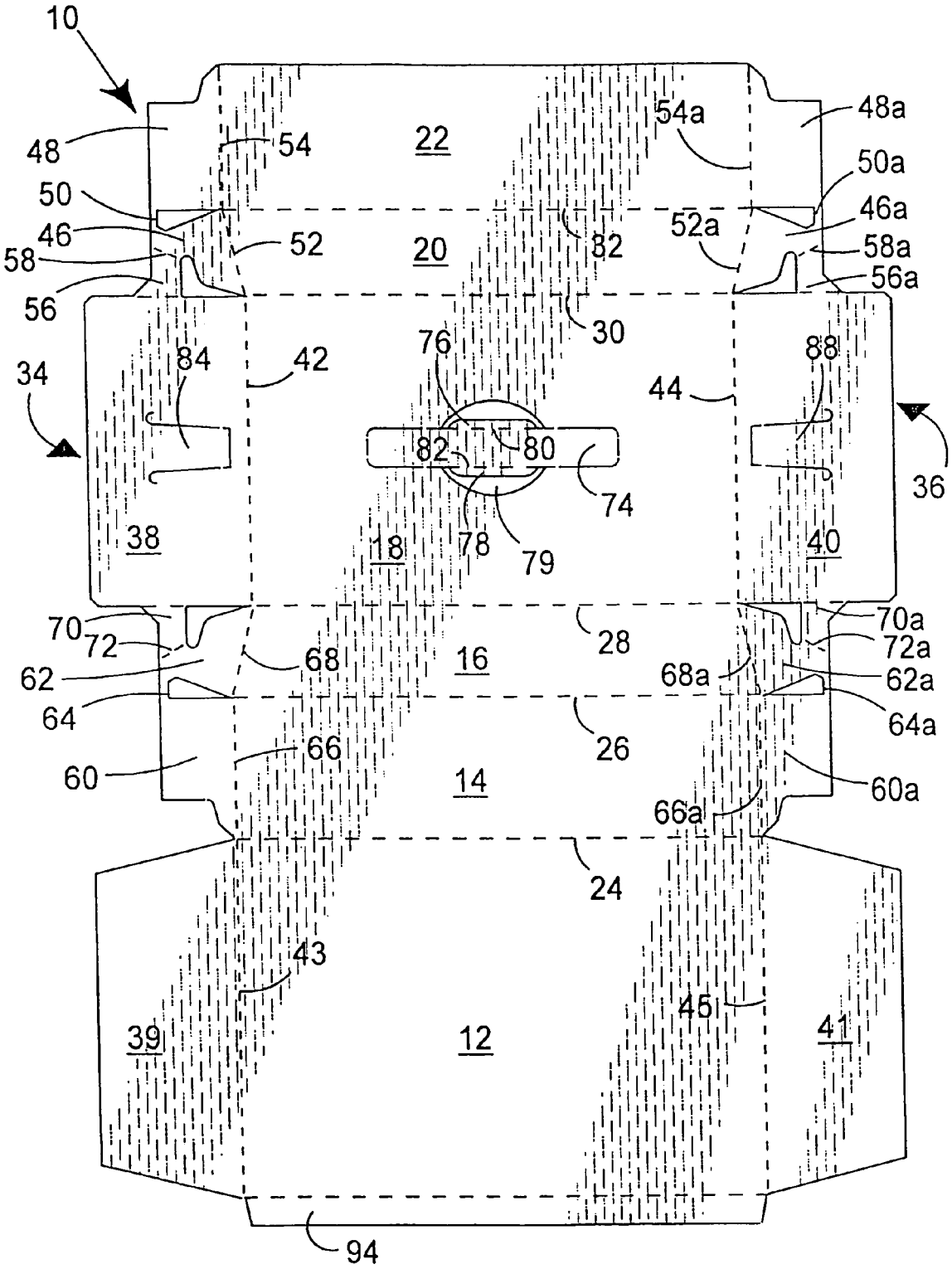
FIG. 1 is a plan view of a blank of a wraparound carton according to one embodiment of the invention.
Figure 2:
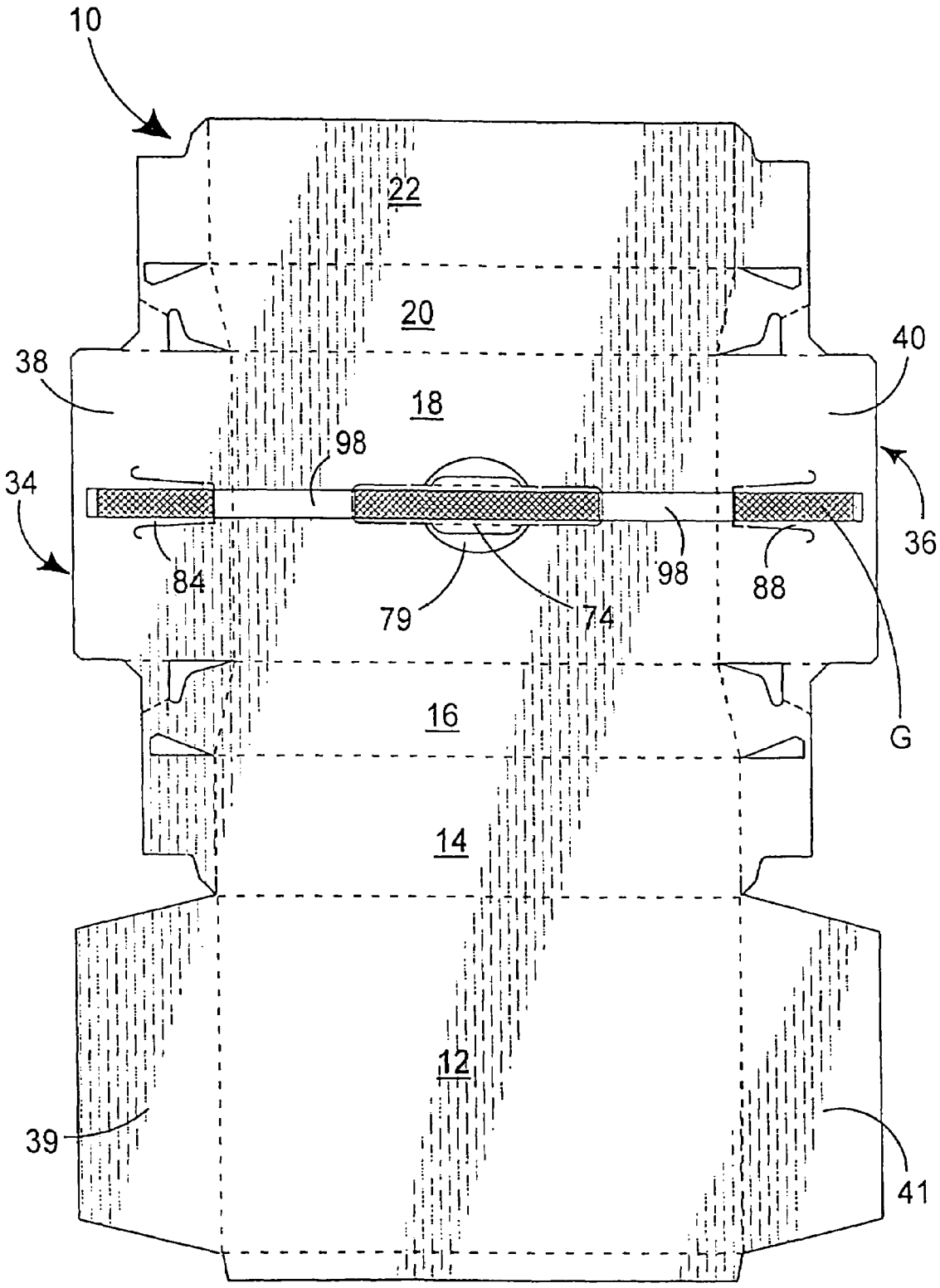
FIG. 2 is a plan view of the blank shown in FIG. 1 incorporating a handle strap.

Referring to the drawings, and in particular FIGS. 1, 2, 6, 7, 10 and 11 thereof, a carton is formed from a unitary blank 10, 210, 310 made from paper board or other suitable foldable sheet material, which can be adapted to accommodate the variety of articles, for example twelve bottles arranged in three rows of four bottles each. It is envisaged the carton can be adapted to accommodate a different number of bottles according to user requirements.

Turning to the carton blank 10 illustrated in FIG. 1, this blank includes a first base panel 12, lower side panel 14, upper side panel 16, top panel 18, second upper panel 20, second lower side panel 22, hingedly connected one to the next in a longitudinal plane along fold lines 24, 26, 28, 30 and 32 respectively.

The blank further comprises an end closure structure 34, 36 including a pair of opposed upper ends closure panels (or "ad panels") 38, 40 hingedly connected to the top panel along interrupted fold lines 42 and 44 respectively, positioned along the end edges of the top panel 18 and a pair of lower end closure panels 39, 41 hingedly connected to base panel 12 along fold lines 43, 45 respectively.

The end closure structure 34 includes gusset panels 46 and 48 connected together by panel portion 50. Gusset panels 46, 48 extend outwardly from lower and upper side panels 22, 20 respectively and are connected thereto by fold lines 52, 54. A further overlapping panel 56 is connected to end closure panel 38 by a lateral fold line and to gusset panel 46 along fold line 58. The gusset panels 46, 48 and overlapping panel 56 are adapted to form a corner structure as is well known in the art.

Likewise, the opposing corner of the end closure structure 34 also includes gusset panels 60 and 62 connected together by panel portion 64. Gusset panels 60, 62 extend outwardly from lower and upper side panels 14, 16 respectively and are connected thereto by fold lines 66, 68. A further overlapping panel 70 is connected to end closure panel 38 by lateral fold line 28 and to gusset panel along fold line 72.

The construction along the opposing side of the top panel and bottom comprises an end closure structure 36 which is similar and therefore like parts at one end of the top panel are designated by reference numerals to like parts of the opposite end with the addition of suffix 'a' and are not described in any greater detail.

The top panel 18 can further comprise a central user portion 74, frangibly connected to the top panel 18. In this embodiment, the central user portion 74 is substantially rectangular in shape and comprises a pair of support panels 76, 78 extending into a central user aperture 79 and connected to the side edges of central user portion along fold lines 80, 82 respectively. Additionally, a handle strap 98, shown in the FIG. 2 can be applied to the inner surface of the blank 10, preferably being secured to the central user portion 74 and the opposed end closure panels 38, 40 by glue at glue points G or by other means known in the art. It is further preferred that the handle strap is formed from paper board, laminated paper board, fibrous tape or other suitable plastics material.

In one class of embodiments, a stabilizing (or bottle neck spacer) flap 84 shown in FIG. 1 is struck from the blank in the end closure panel 38 so that the flap 84 is hinged to that panel, but otherwise cut out from the blank. Likewise, a second flap 88 is struck from the other end closure panel 40 and is hingedly connected thereto.

Figure 6:
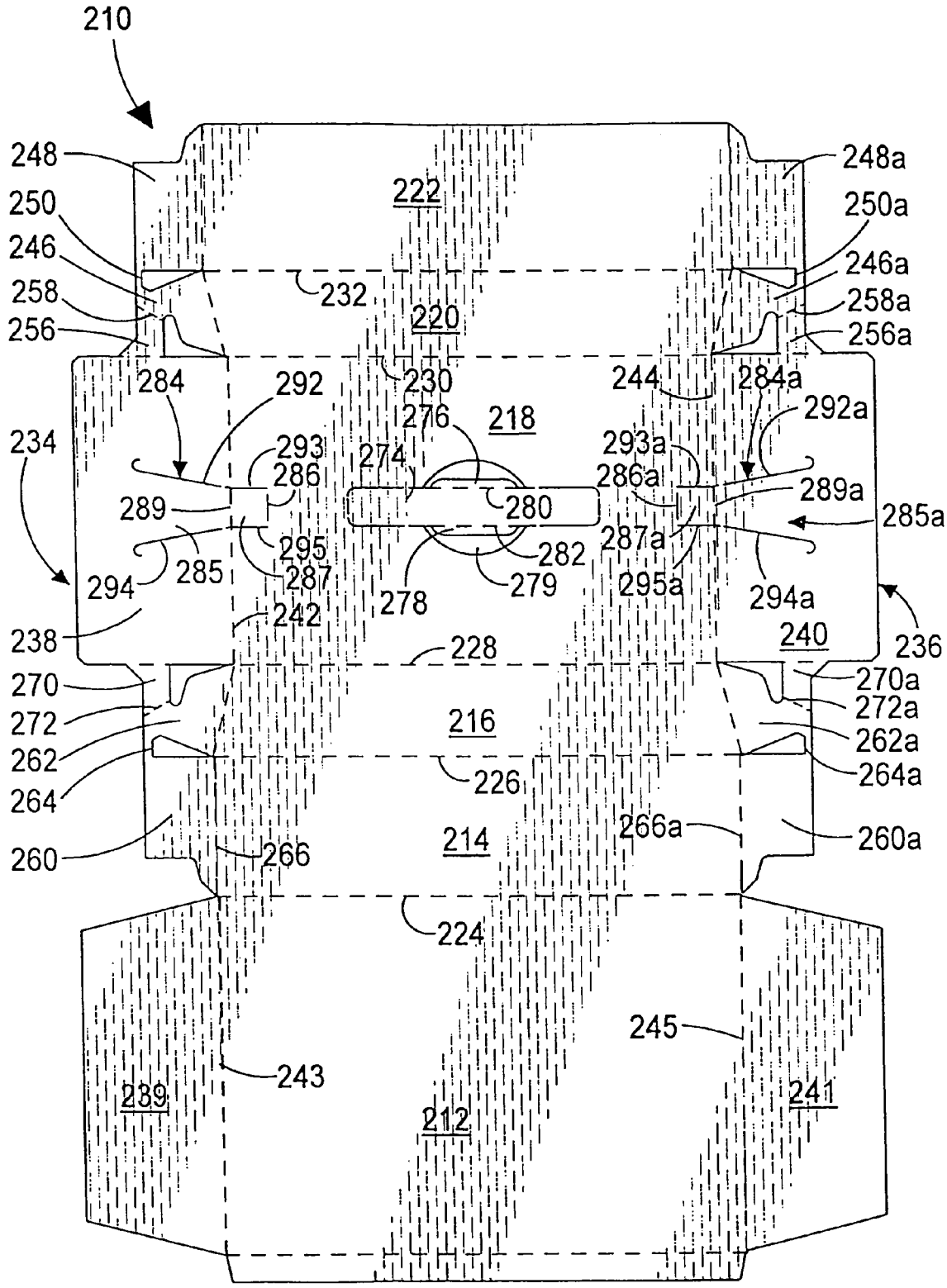
FIG. 6 is a plan view of a blank of a wraparound carton according to a second embodiment of the invention.
Figure 7:
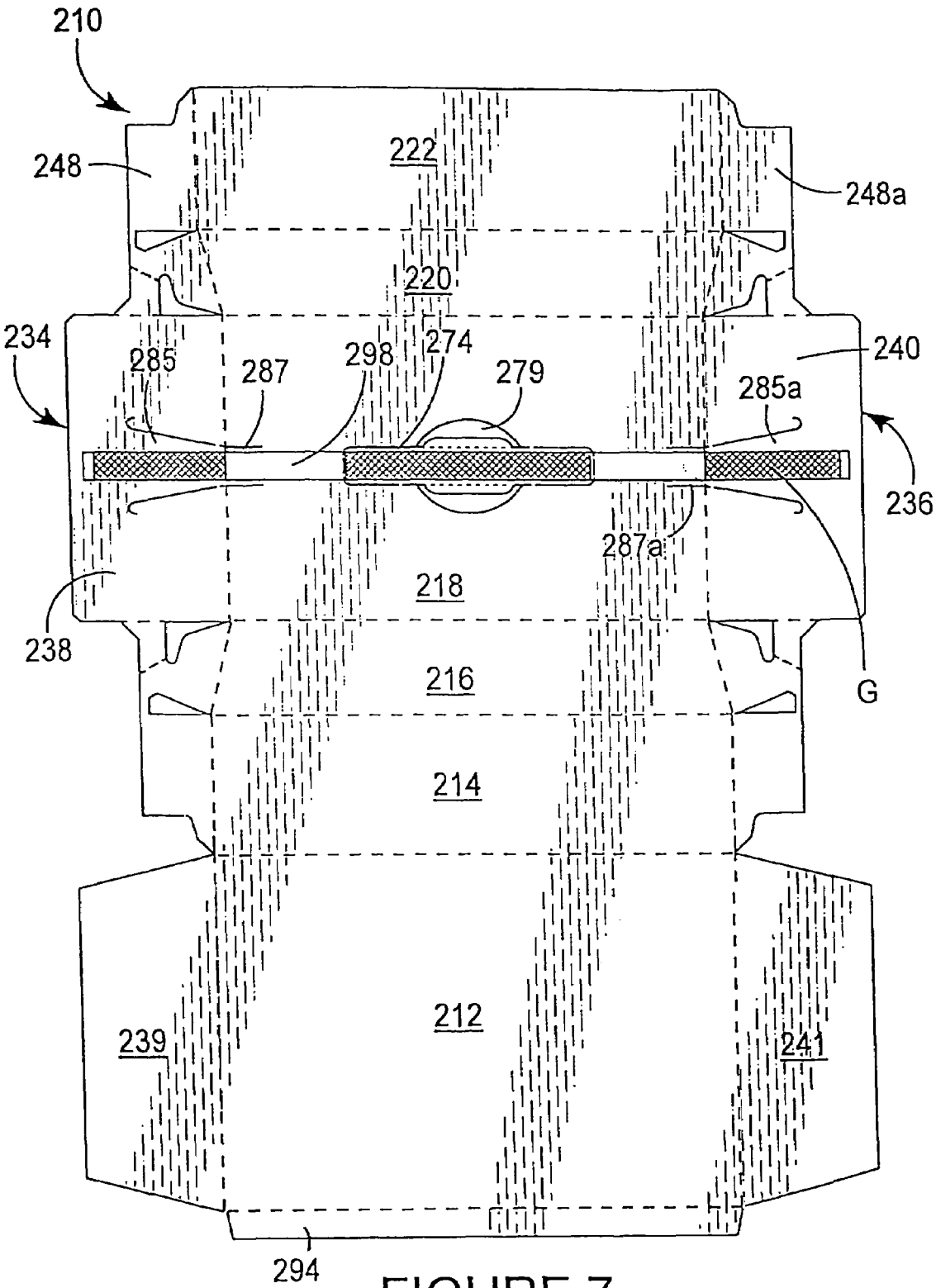
FIG. 7 is a plan view of the blank shown in FIG. 6 incorporating a handle strap.

The second embodiment shown in FIGS. 6 and 7 corresponds substantially to the first embodiment and therefore like parts are designated by reference numerals which are prefixed with the numeral "2". Only those parts of the second embodiment which differ from the first embodiment are hereinafter described. Thus, a stabilizing (or bottle neck spacer) flap 284 shown in FIG. 6 is struck from the blank in the end closure panel 238 so that the flap 284 is hinged to that panel and to the top panel about fold line 286, but otherwise cut out from the blank. Flap 284, preferably comprises a tread panel 285 and a riser panel 287, connected together along fold line 289, which panels are adapted during carton construction to define a step (or keel element).

The top panel 218 can further comprise a central user portion 274, frangibly connected to the top panel 218. In this embodiment, the central user portion 274 is substantially rectangular in shape and comprises a pair of support panels 276, 278 extending into a central user aperture 279 and connected to the side edges of central user portion along fold lines 280, 282 respectively. Additionally, a handle strap 298, shown in FIG. 7 can be applied to the inner surface of the blank 210, being secured to the central user portion 274 and the opposed end closure panels 238, 240 by glue at glue points G or by other means known in the art. Preferably, the handle strap 298 is also glued, or otherwise secured, to the tread panels 285, **285*a* of each step as shown in FIG. 7**. It is further preferred that the handle strap is formed from paperboard, laminated paperboard, fibrous tape or other suitable plastics material.

The third embodiment shown in FIGS. 10 to 13 corresponds substantially to the first and second embodiments in many respects and therefore, where possible, like parts are designated by numerals which are prefixed with the numeral "3". Turning to the carton blank 310 illustrated in FIG. 10, this blank includes a base panel 312, lower side panel 314, upper side panel 316, top panel 318, second upper panel 320, second lower side panel 322, hingedly connected one to the next in a longitudinal plane along fold lines 321, 326, 328, 330 and 332 respectively.

The blank further comprises one or more end closure structures 334, 336 including a pair of opposed upper ends closure panels (or "ad panels") 338, 340 hingedly connected to the top panel along fold lines 342 and 344 respectively, positioned along the opposing end edges of top panel 318. In this embodiment, the end closure structures 334, 336 also include a pair of lower end closure panels 339, 341 hingedly connected to base panel 312 by fold lines 343, 345 respectively formed along the opposed longitudinal edges of base panel 312.

End closure structure 334 may also include gusset panels 346 and 348 connected together by panel portion 350. Gusset panels 346, 348 extend outwardly from lower and upper side panels 322, 320 respectively and are connected thereto by fold lines 352, 354. A further overlapping panel 356 is connected to upper end panel 338 by a lateral fold line and to gusset panel 346 along fold line 358. The gusset panels 346, 348 and overlapping panel 356 are adapted to form a corner structure, as is well known in the art.

Likewise, the opposing corner of the end closure structure 334 also includes gusset panels 360 and 362 connected together by panel portion 364. Gusset panels 360, 362 extend outwardly from lower and upper side panels 314, 316 and are connected thereto by fold lines 366, 368. A further overlapping panel 370 is connected to upper end panel 338 by a lateral fold line and to gusset panel along fold line 372.

The construction along the opposing side of the top panel and bottom, which includes end closure structure 336, is similar and therefore, like parts at one end of the top panel are designated by reference numerals to like parts of the opposite end, but with the addition of suffix 'a' and are not therefore described in any greater detail.

Figure 10:
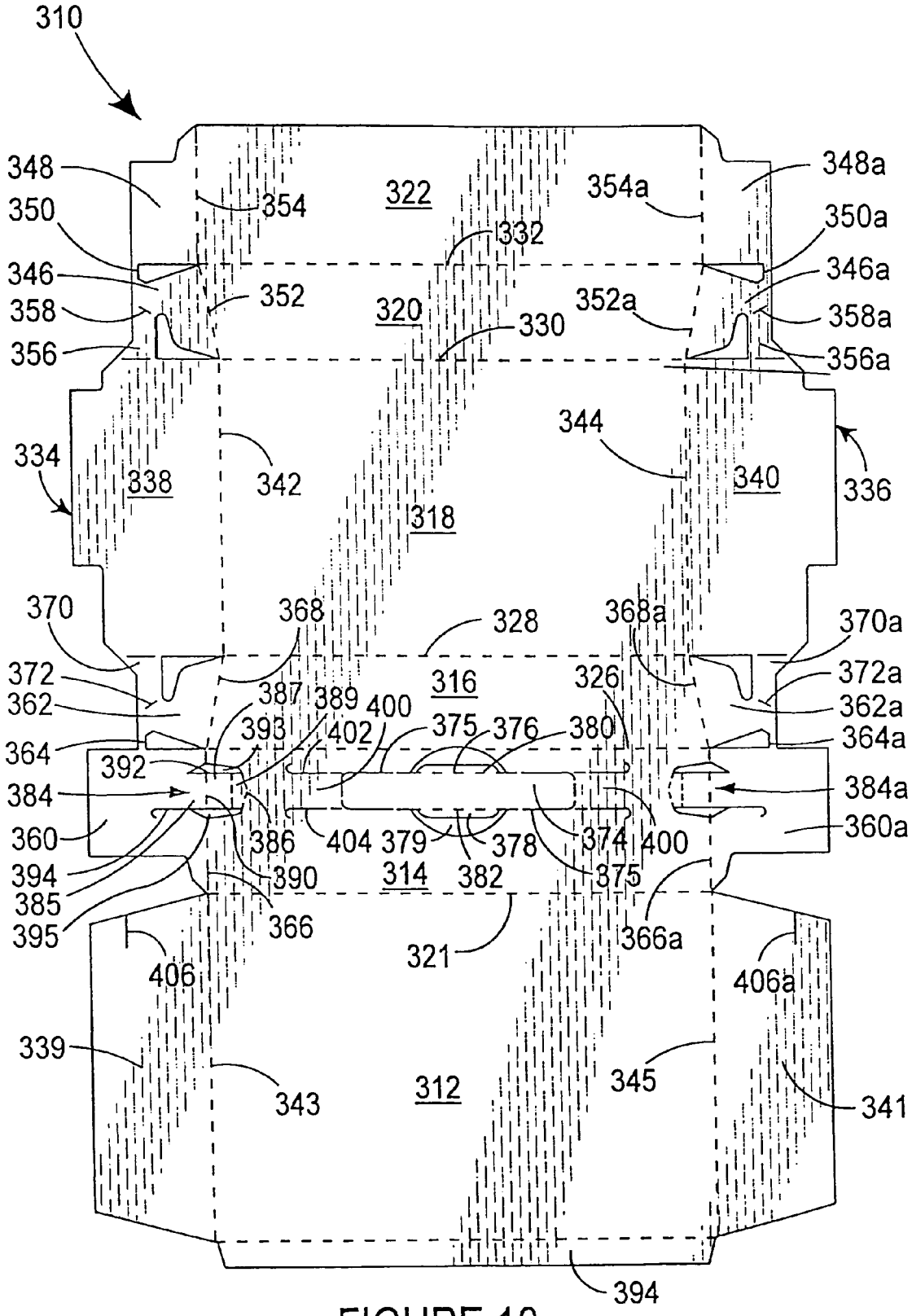
FIG. 10 is a plan view of a blank for a wraparound carton according to a third embodiment of the invention.

One or more handle flaps 384, **384*a*, shown in FIG. 10, is struck from the blank, which in this embodiment is formed from the gusset panel 360 and/or side panel 314, so that the flap 384 is hinged to that panel 360 and preferably to the side panel 314 about fold line 386, but is otherwise cut out from the blank by opposed cut lines 392, 394 in substantially parallel spaced arrangement. Flap 384, preferably comprises a tread panel 387 and a riser panel 389, connected together along a fold line, which panels are adapted during carton construction to define a step (or keel element). In this embodiment the tread panel 387 is separated from the gusset panel 360 by panel 385 and hingedly connected thereto along fold line 390** described in more detail below.

Preferably, the handle flap 384 is separated from gusset panel 360 and lower side panel 314 by apertures 393, 395 to make it easier for the flaps to be folded out of alignment with the gusset panel 360 and lower side panel 314.

The side panel 314 may further comprise a user portion 374, frangibly connected to the side panel 314 along frangible lines 375 and positioned in a central region of the side panel. In this embodiment, the user portion 374 is substantially rectangular in shape and comprises a pair of support panels 376, 378 extending into a central user aperture 379 and connected to the side edges of central user portion along fold lines 380, 382 respectively.

Figure 11:
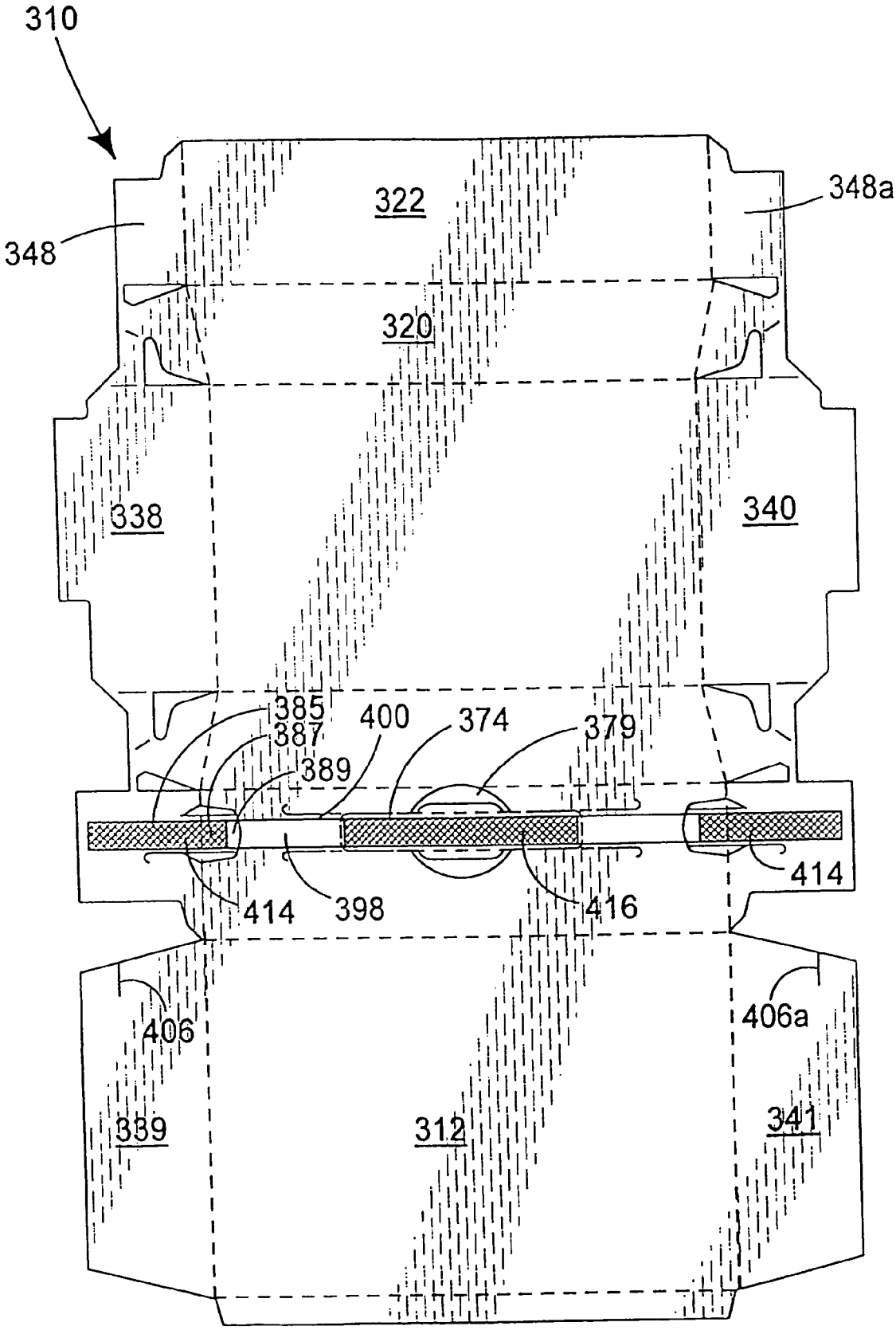
FIG. 11 is a plan view of the blank shown in FIG. 10 incorporating a handle strap.

Additionally, a handle strap 398, shown in the FIG. 11 can be applied to the inner surface of the blank 310, preferably being secured to the user portion 374 and the opposed gusset panels 338, 340 by glue 416, 414 or other means known in the art. Preferably, the handle strap 398 is also glued to the tread panels 385, 387 of each step. It is further preferred that the handle strap is formed from paperboard, laminated paperboard, fibrous tape or other suitable plastics material.

Along the opposed lateral edges of user portion 374, there may further comprise a handle tab 400 struck from lower side panel 314 by lateral cut lines 402, 404. In use, the handle tabs guide the handle strap when displaced outwardly.

Cut lines 406, 406*a* struck from lower end panels 339 and 341 may be included to co-operate with handle flaps 384, 384*a*.

In another class of embodiments, the handle structure may comprise one or more handle flaps (not shown) struck from the gusset panel 360 or other suitable panel so that the flap is hinged to that panel along one edge but is otherwise cut out from the blank in a manner similar to the first embodiment. Likewise a second flap could be struck from the opposing gusset panel 360*a* or other suitable panels and be hingedly connected thereto. A handle strap would be secured to the opposing handle flaps and preferably a user portion, but would otherwise be unconnected to the blank.

Turning to the construction of the carton, illustrated in FIGS. 3, 4, 5, 8, 9 and 12, 13 the blank 10, 210, 310 requires a series of sequential folding and/or gluing operations which can be performed in a straight line machine so that the carton is not required to be rotated or inverted to complete its construction. The folding process is not limited to that described below and can be altered according to particular manufacturing requirements.

The carton is usually supplied to a bottler in a flat collapsed tubular condition: the base panel 12, 212, 312 already connected to lower side panel 22, 222, 322 by securing the glue flap 94, 294, 394 to the lower side panel 22, 222, 322 by glue or other suitable means. In order to set up the carton, the sides and top and base panels are separated to form a tubular structure, as is well known.

Thereafter, articles are introduced to the part constructed carton and the end closure structure is formed. In the first embodiment, the end closure panels 38 and 48 are folded downwardly at each end of the sleeve formed by the wrap around folding action. Gusset panels 46, 48, 50 and 60, 62, 70 are folded inwardly about fold lines 52, 54 and 66, 68 respectively whereby gusset panels 46, 48, 60, 62 come into face to face relationship with side panels 22, 20 and 14, 16 respectively. Panels 56, 70 come into face to face contact with their respective adjacent gusset panels 46, 62.

Optionally, the faces of gusset flaps 46, 60 in contact with upper side panels 16, 20 respectively may be secured together by means known in the art to hold the end closure panels in place. Thereafter, lower end closure panels are folded about fold lines and into abutment with upper end closure panels 38, 40 and are secured together by glue or other means known in the art. The end structures of the second and third embodiments are formed in a substantially identical manner and construction thereof is not therefore described in any greater detail.

Figure 3:
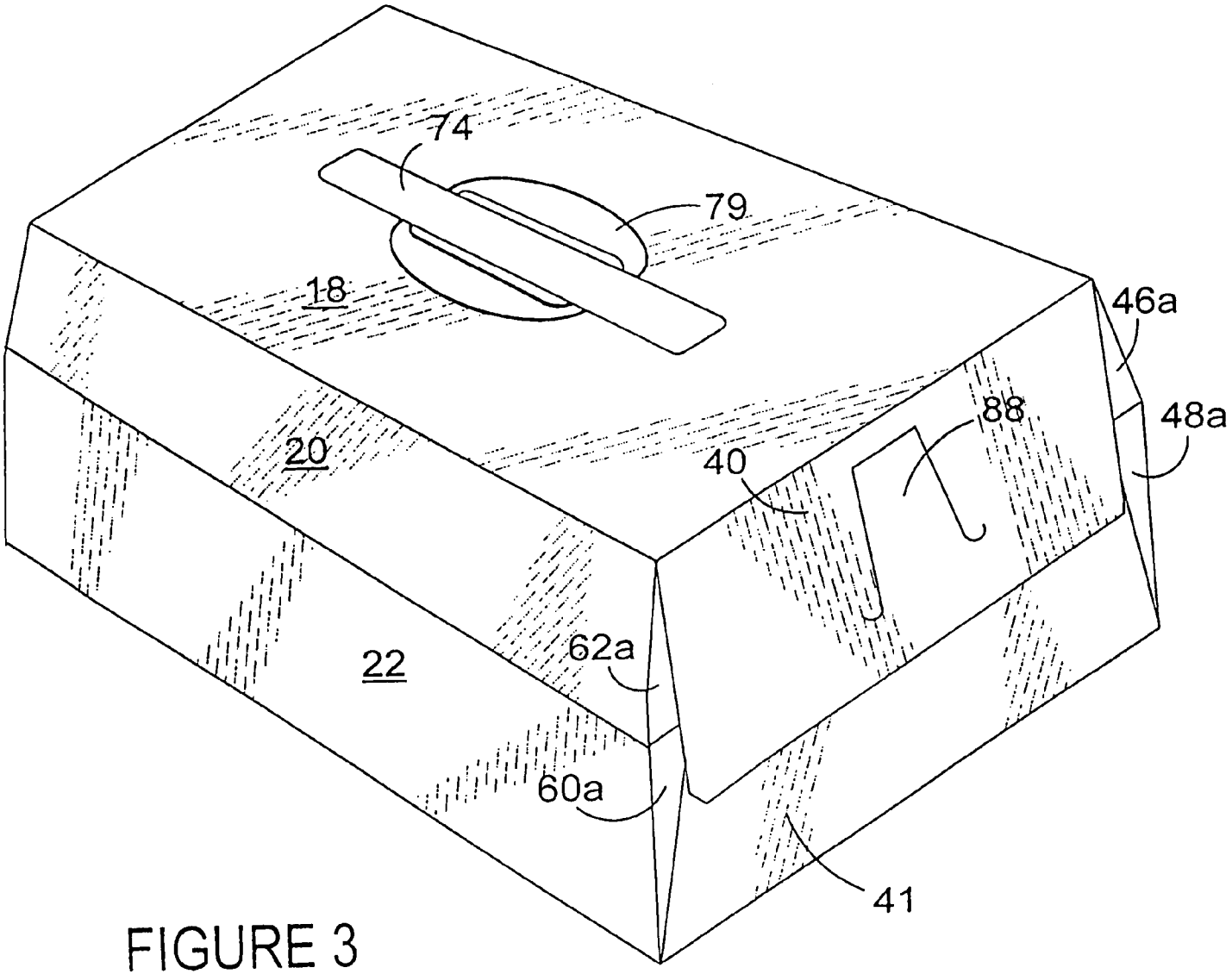
FIG. 3 is a perspective view of a carton formed from the blank shown in FIG. 1.
Figure 8:
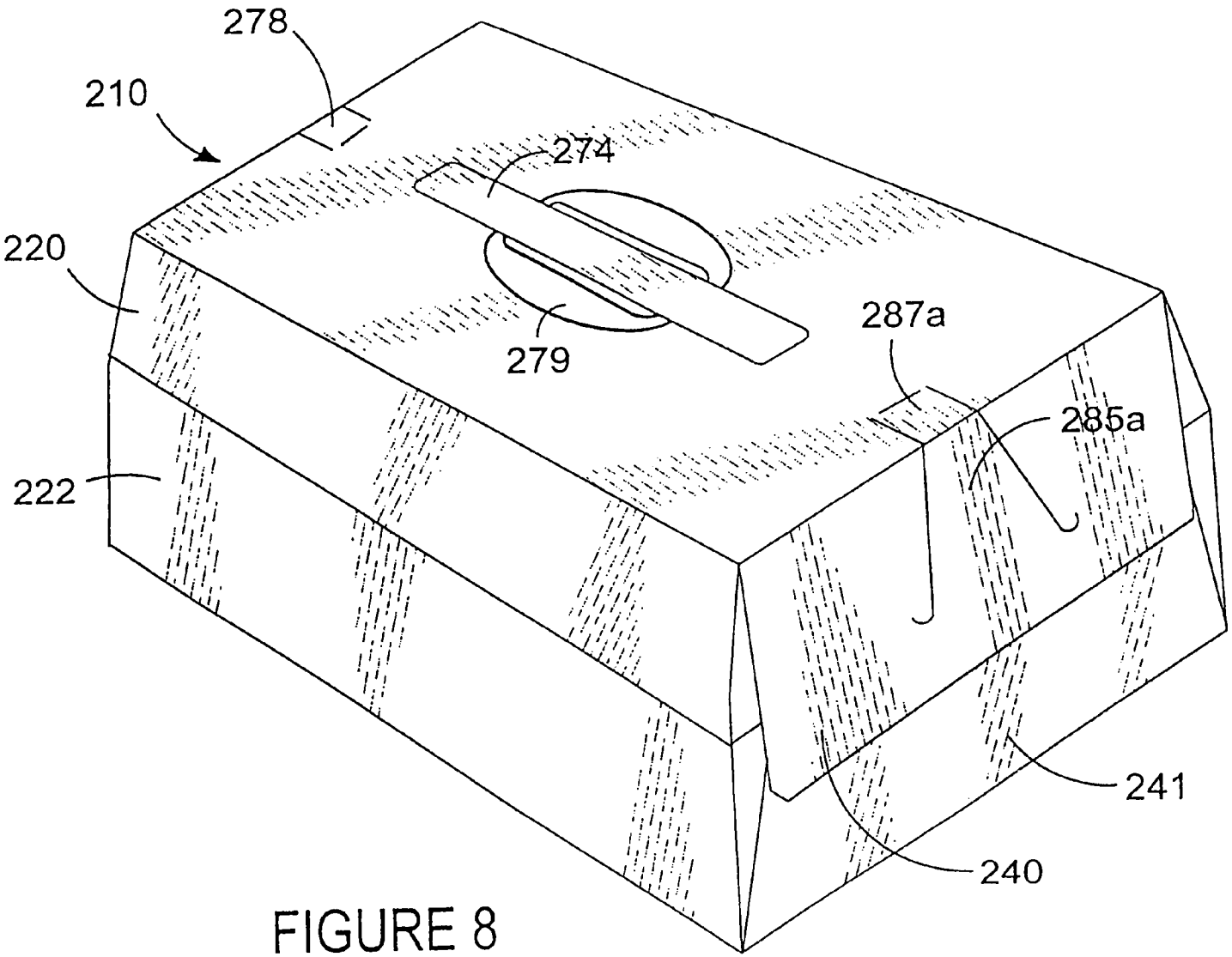
FIG. 8 is a perspective view of a carton formed from the blank shown in FIG. 6.
Figure 12:
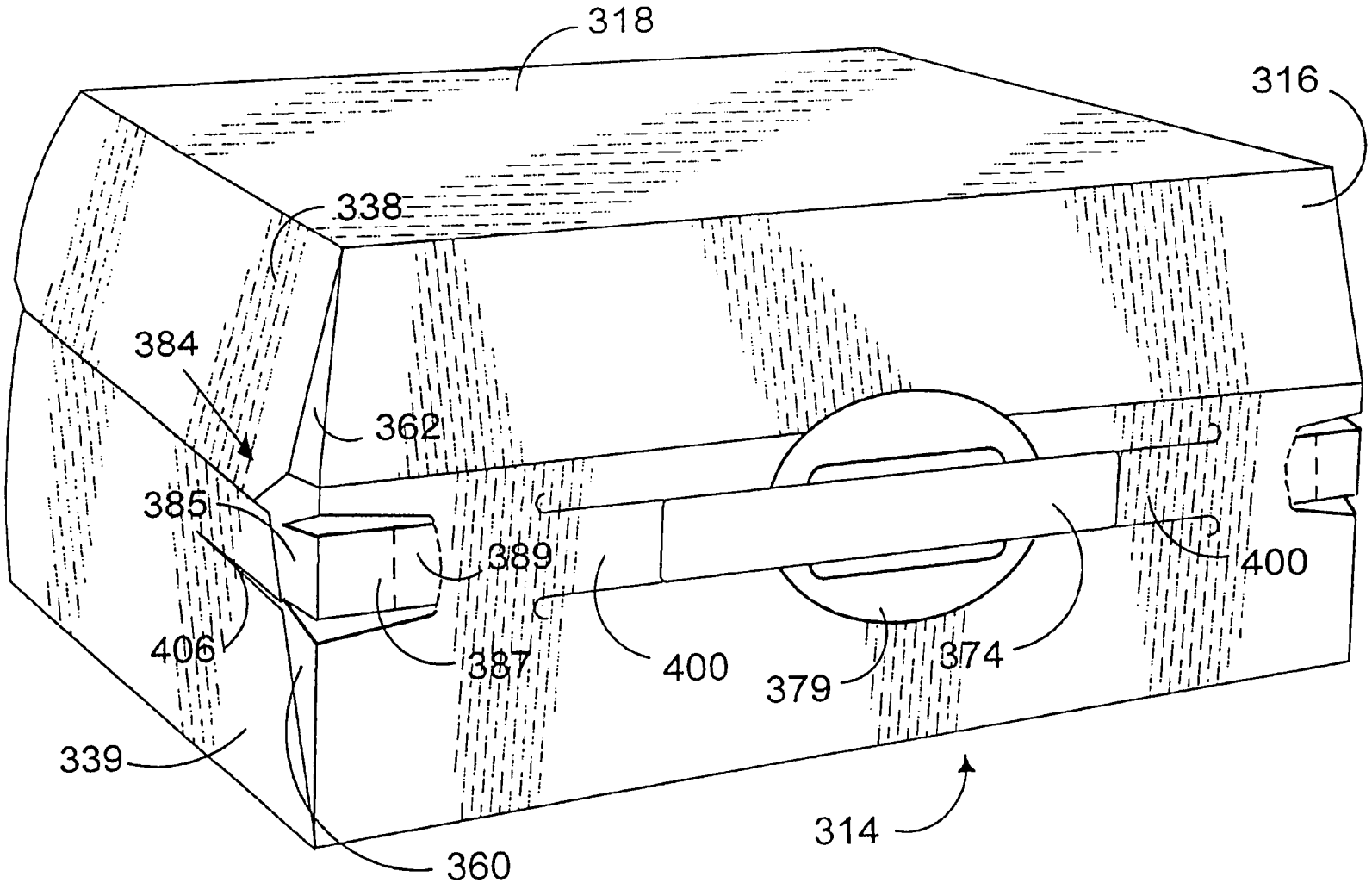
FIG. 12 is a perspective view of a carton formed from the blank shown in FIG. 10.

Thus, the cartons of the first, second and third embodiments are in a set up and loaded condition as shown in FIGS. 3, 8 and 12 respectively. The first embodiment advantageously allows the top and the end of the carton to remain intact thereby improving the structural integrity of the carton during handling and storage, caused in part because the fold lines connecting the top and upper side panels are continuous.

The embodiment shown in FIG. 12 allows the top of the carton to remain intact and thereby also improves the structural integrity of the carton during handling and storage, again caused in part because the fold lines connecting the top and upper side panels are continuous.

Figure 4:
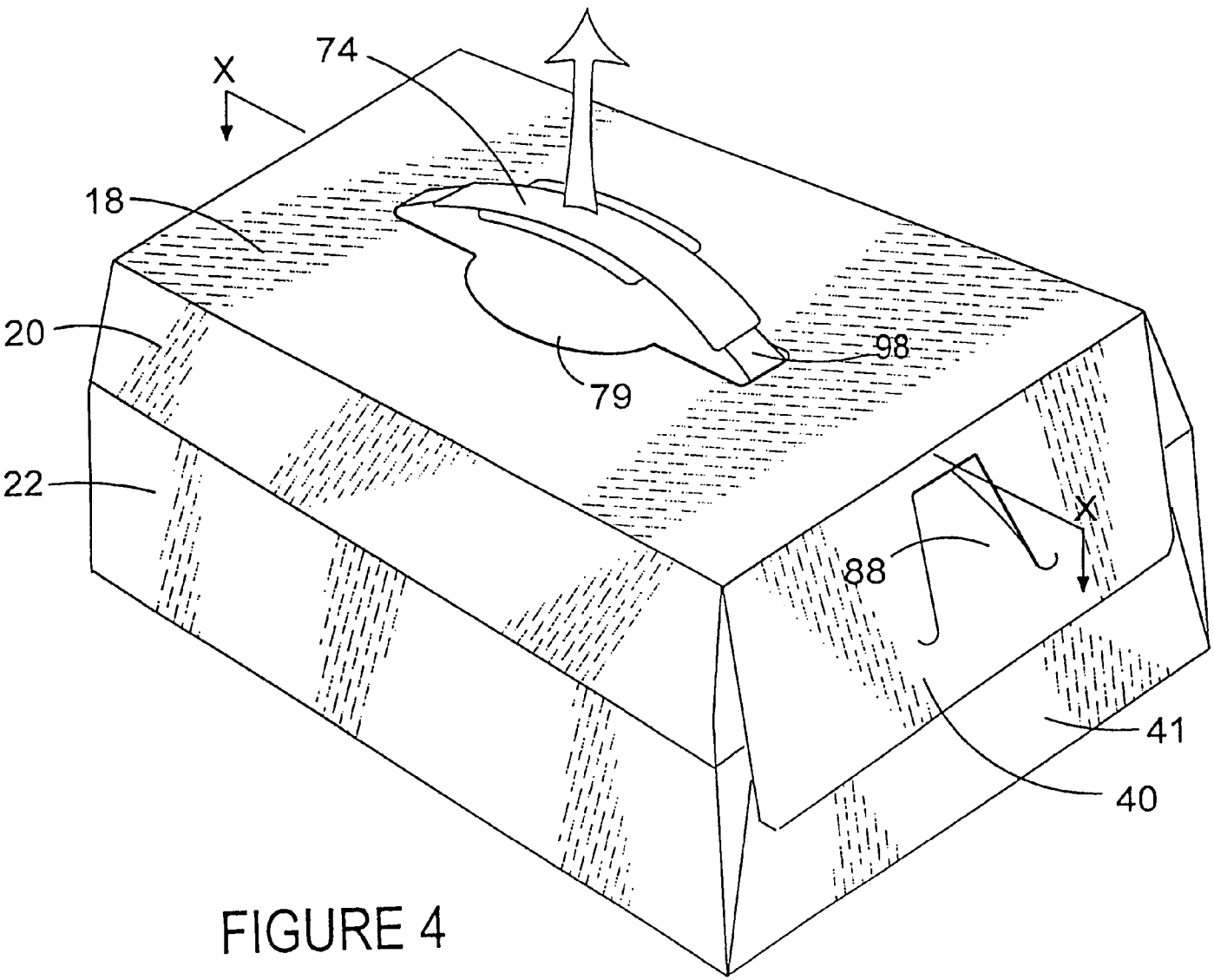
FIG. 4 is a perspective view of the carton shown in FIG. 3 illustrating the handle structure in a set up condition.
Figure 5:
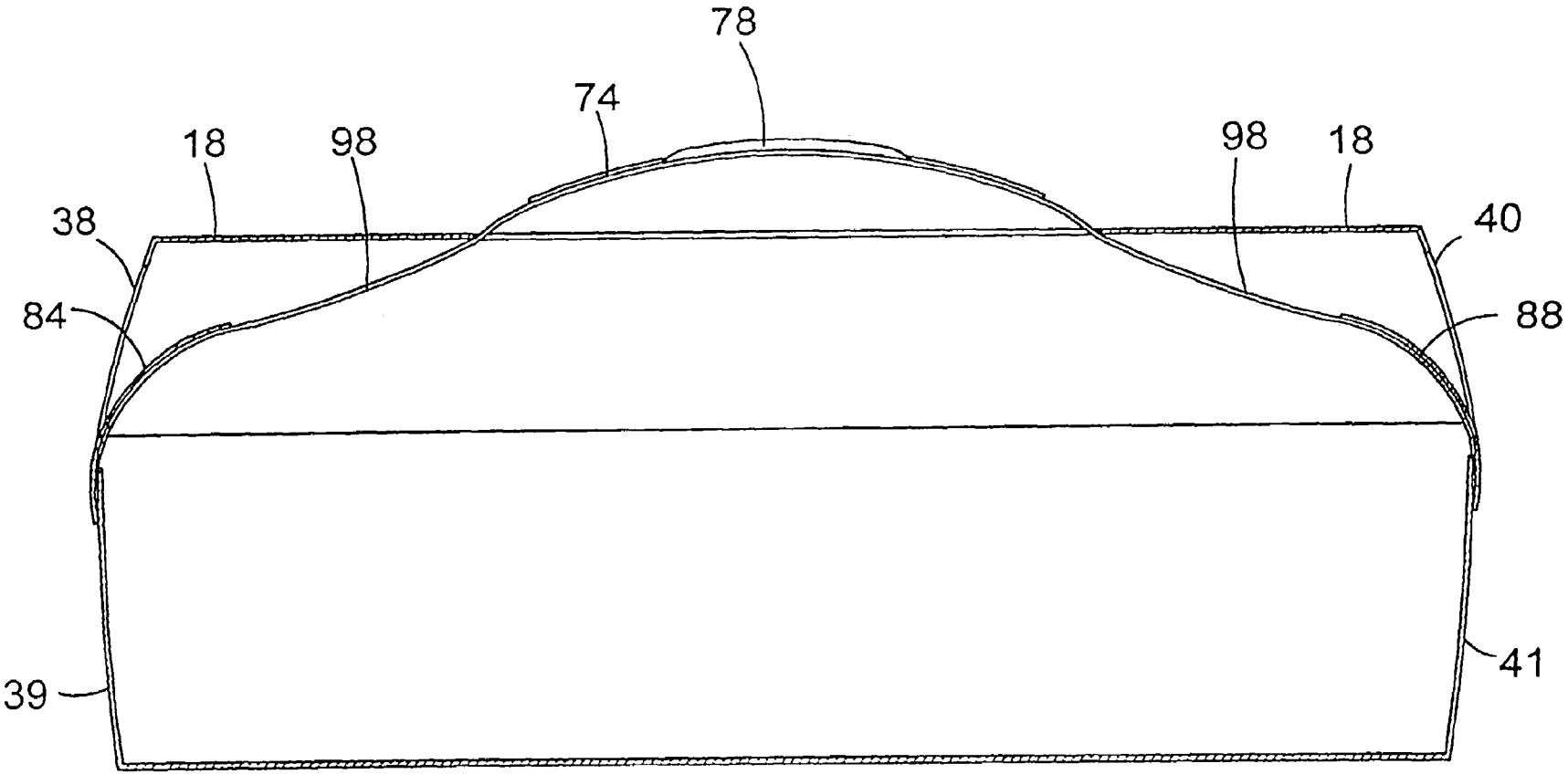
FIG. 5 is a cross sectional view of the carton shown in FIG. 4 through "X-X"

In order to form the handle in the first embodiment illustrated in FIGS. 4 and 5, the central user portion 74 can be detached from the top panel 18 whereby at least a portion of the handle strap stands proud of the top panel, shown in FIG. 4. It will be seen from FIG. 5 that the strap is so connected at the opposite ends of the end closure panels as to provide a surplus of material to enable the central user portion 74 to be brought into a position of use. The support panels 76, 78 are folded under the handle strap, such that the central user portion 74 is wrapped around the strap, the central user portion 74 provides a cushion for the strap, shown in FIG. 4. Further, the central user portion 74 is designed for ease of use.

Figure 9:
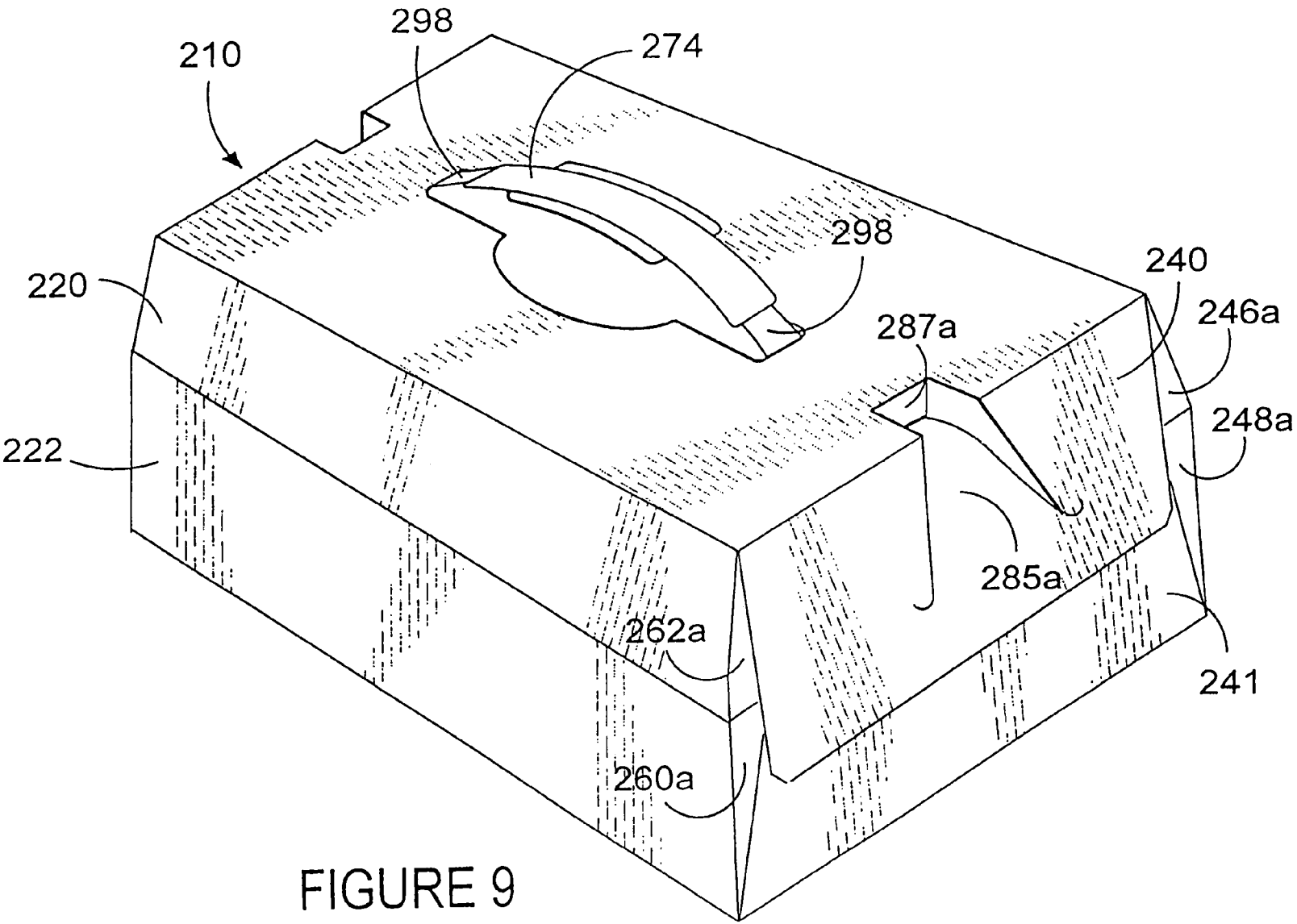
FIG. 9 is a perspective view of the carton shown in FIG. 8 illustrating the handle structure in a set up condition.

In the second embodiment, the handle is formed by folding each of the stabilizing (or bottle neck spacer) flaps 284 and 284*a*. Flaps 284 and 284*a* are formed with cut lines 292, 294 preferably divergent from fold line 289 and cut lines 293, 295 intermediate and substantially perpendicular to fold lines 286 and 289 about which flaps can fold in a toggle action to define a step at each end of the top panel 18. This action can occur automatically upon folding the end closure panels which brings the flaps into their operative position in which the flaps are displaced out of the plane of the top panel inwardly of the carton, as shown in FIG. 9. Optionally, cut lines 292, 294; 293, 295 are shaped to define a shaped edge adapted to cooperate with a neck portion of an article. Once displaced the, or each, stabilizing flap 284 is disposed between neck portions of adjacent rows of articles within the package to assist in maintaining the articles in their correct upright positions within the package, particularly to prevent the articles topping inwardly whereas the end closure panels prevent the bottles toppling end wise of the package.

Figure 13:
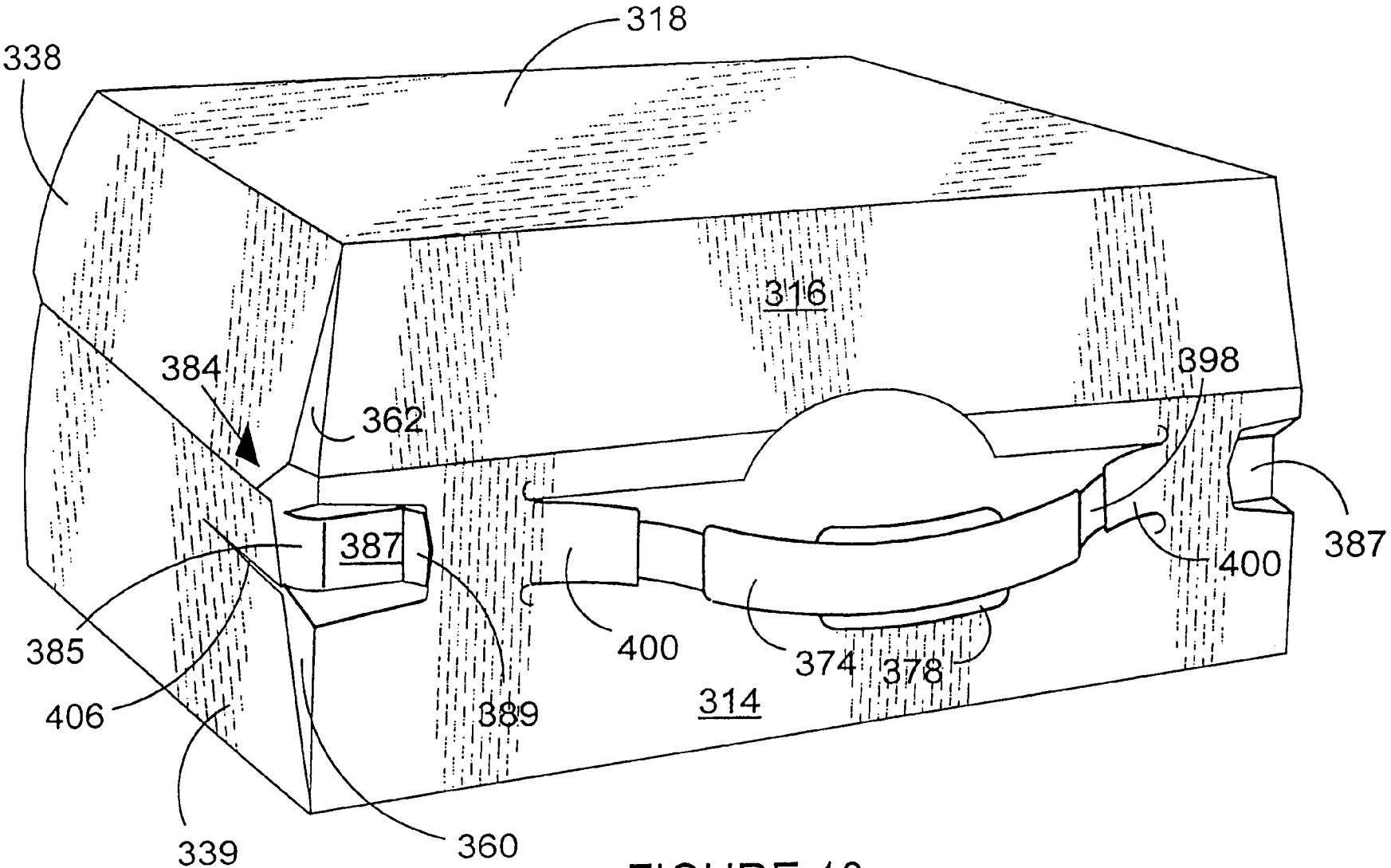
FIG. 13 is a perspective view of the carton shown in FIG. 12 illustrating the handle structure in a set up condition.
Figure 14:
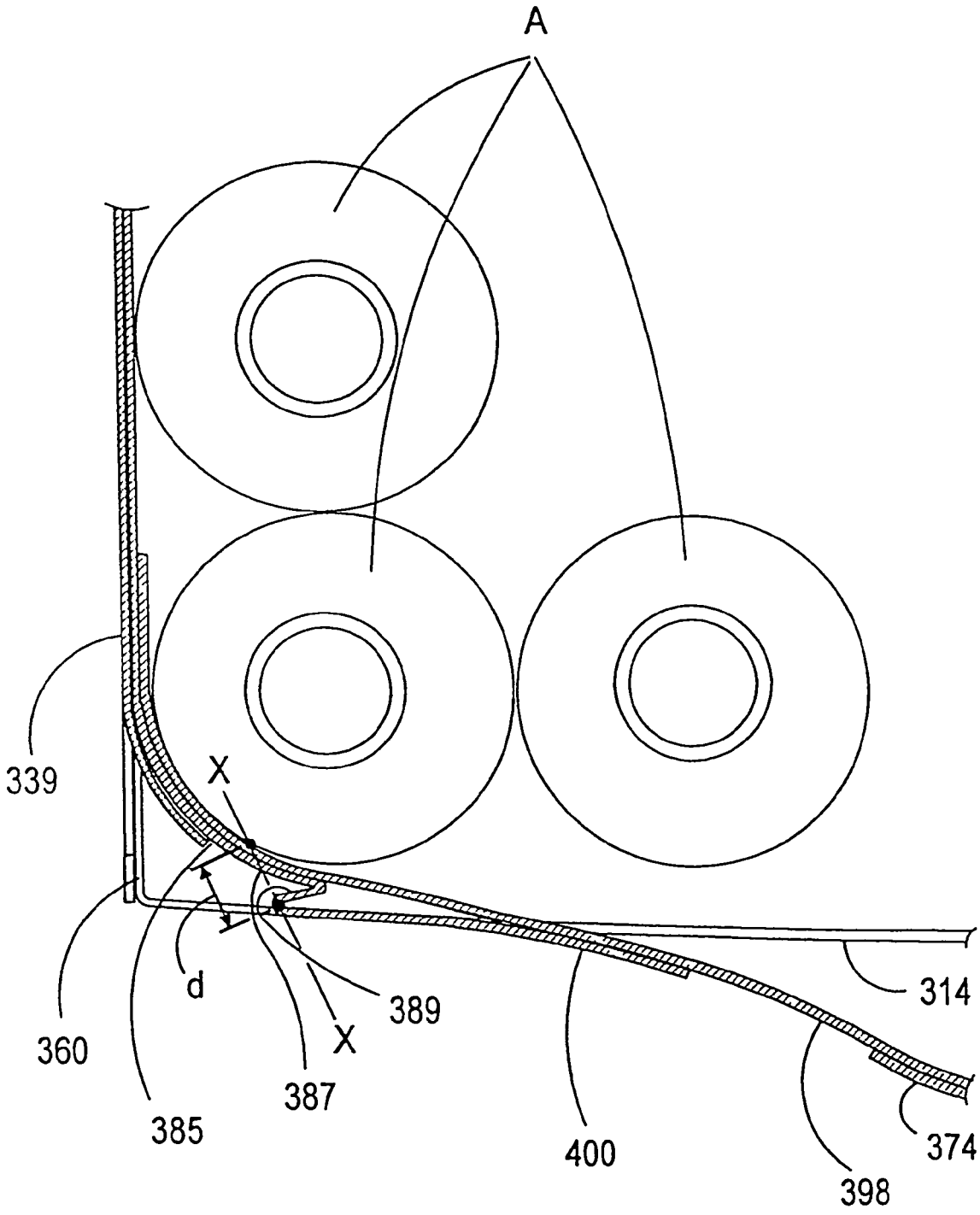
FIG. 14 is a cross sectional view of a portion of the carton shown in FIG. 13, illustrating the arrangement of handle flaps.

In order to form the handle of the third embodiment as illustrated in FIG. 13 the user portion 374 can be detached from the side panel 314 and, the handle is then formed automatically by folding each of the handle flaps 384. More particularly, a keel structure is formed by folding panels 385, 387 and 389 inwardly of gusset panel 360 such that tread panel 385, 387 and riser panel 389 are substantially perpendicular or more preferably in an acute angular relationship. Thus, the flaps 384 can fold in a toggle action to define a step at each end of the lower side panel 314. This action can occur automatically when a user pulls on the handle strap which brings the flaps into their operative position by which the flaps are displaced out of the plane of the top panel inwardly of the carton, as shown in FIG. 13. Once displaced, the or each panel 385 abuts the product as shown in FIG. 14. Preferably, once the step is formed and the tread and riser panels are folded into perpendicular (or angular) relationship, they are so constructed to be held in place. More preferably, when the user forms the step, it is "overcentre" of the notional plane X-X between the tangential point of contact between the article and strap and the fold line between the riser and side panel and therefore is prevented from collapsing back to a co-planar relationship with the side and gusset panels. In some embodiments, this is achieved because the tread panel 387 and/or riser panel 389 is greater in length than the distance "d" between the side panel 314 and the article A. Advantageously, the strap 398 is held between the product and carton (FIG. 14) which permits additional resistance.

One advantage of this arrangement of handle structure is that the handle structure is more rigid and once the user part has been separated from the side panel it continues to protrude beyond the side panel whilst providing a handle strap that can be shaped to the contour of the outermost article A carried by the carton.

When the carton of any of the above embodiments is in use, there is a tendency for the handle strap to draw the end closure structures 34, 36, 234, 236, 334, 336 inwardly thereby to improve the integrity of the carton and providing a self tightening effect. Furthermore, in those embodiments where the strap and/or tread and riser flaps are positioned between neck portions of adjacent bottles, the stability of the carton is improved due to support from the articles.

The carton of each of the above embodiments is set up as an open-ended sleeve for loading and is then end-loaded whereafter the carton is completed by closure of the end closure panel. The end closure panel closing has an effect on the disposition of the handle strap. As the top end closure panels are folded into their closing positions the handle strap becomes slack into a position ready for use. When the carton is lifted by the central user part of the handle strap, the strap bows upwardly and protrudes through the central user aperture proud of the top/side wall. The load is transmitted from the handle strap to the end wall of the carton at each of the opposite ends of the handle access aperture and is distributed through the end wall.

Figure 15:
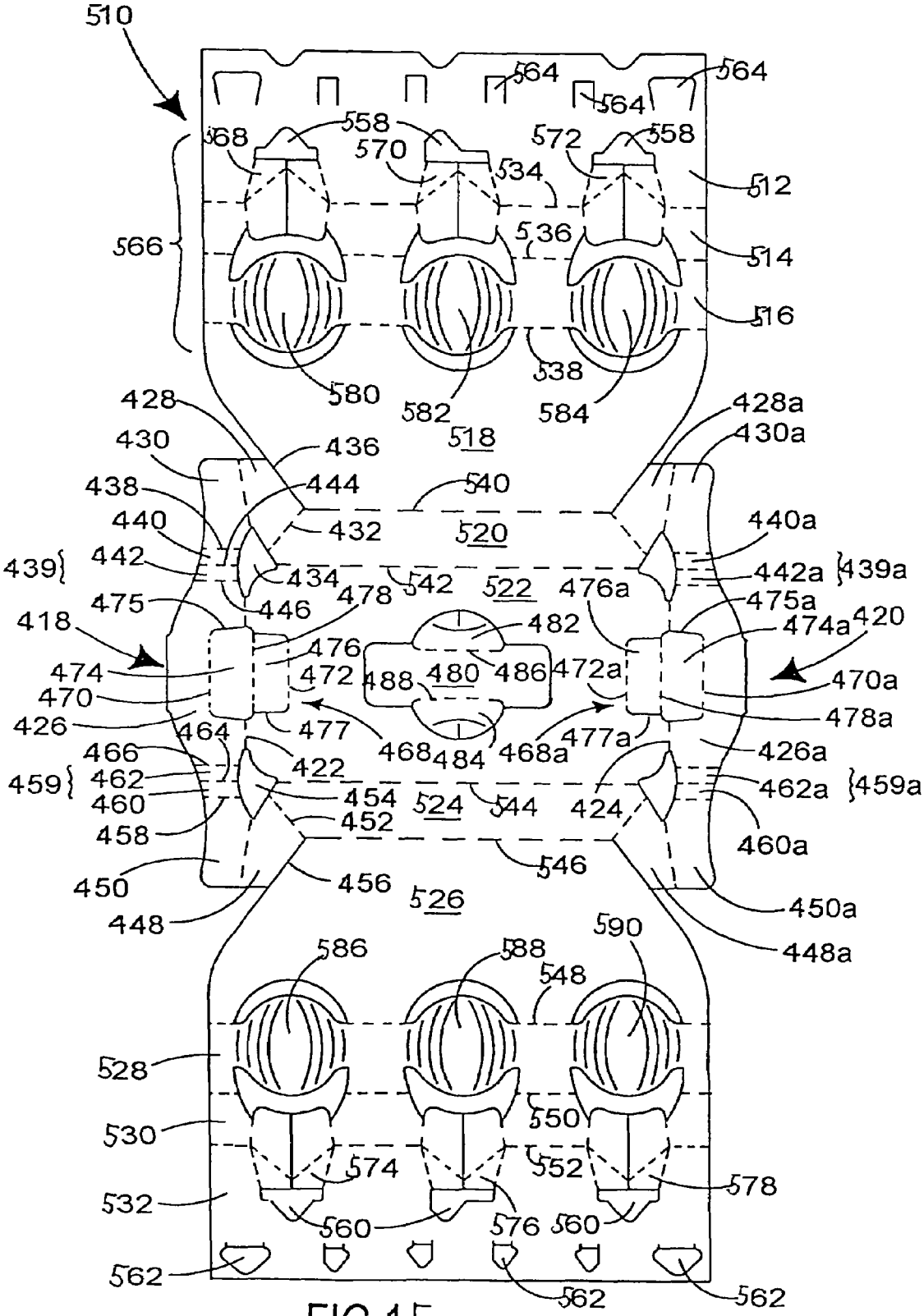
FIG. 15 is a plan view of a blank of a wraparound carton according to a fourth embodiment of the invention.
Figure 16:
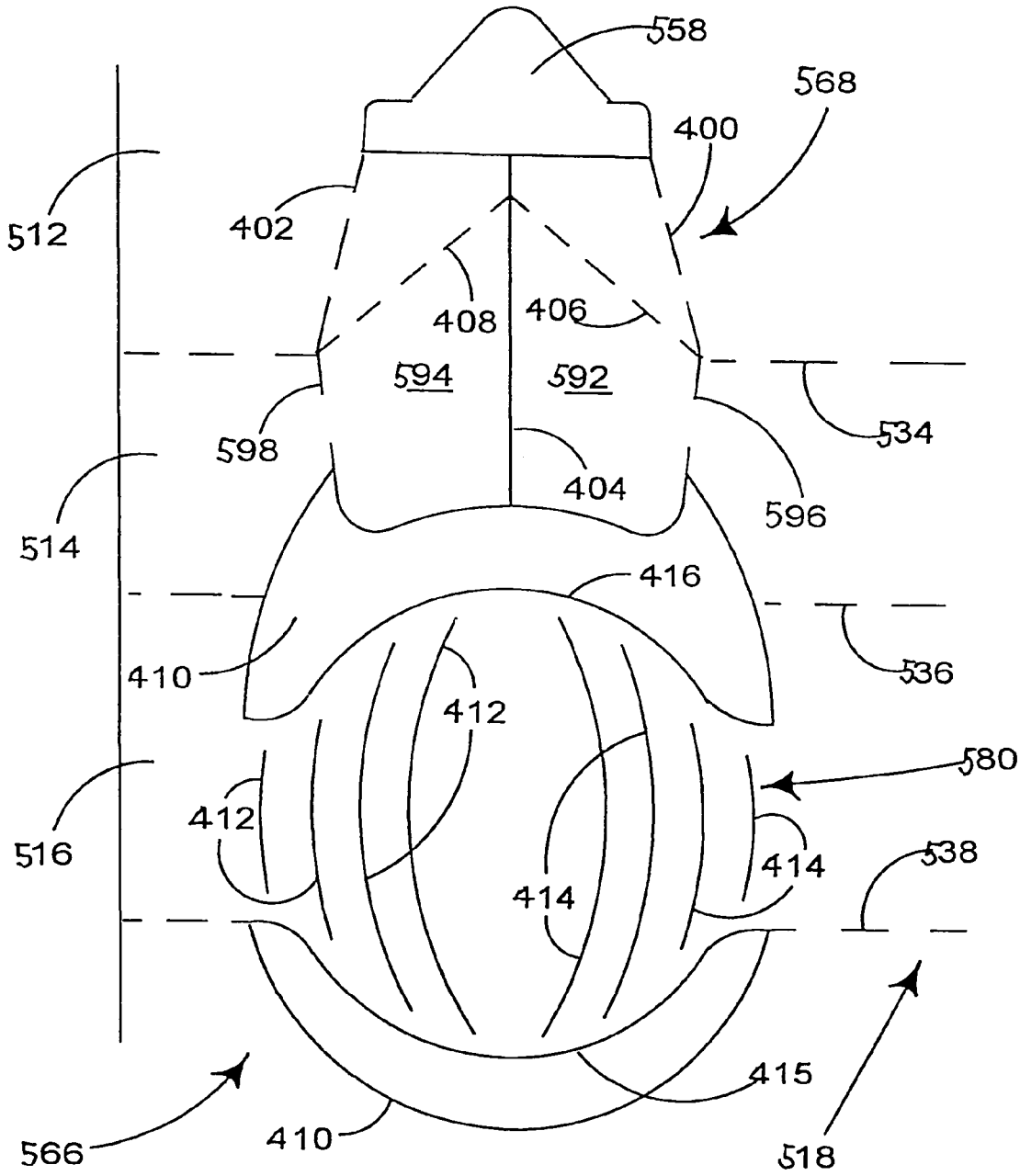
FIG. 16 is a plan view of part of the blank shown in FIG. 15, illustrating the portion for receiving and retaining an article.

FIGS. 15-19 illustrates a carton of the fourth embodiment. Referring to FIGS. 15 and 16, the carton is formed from a unitary blank 510 made from paper board or other suitable foldable sheet material, which can be adapted to accommodate the plurality of articles, for example six bottles arranged in two rows of three bottles each. It is envisaged the carton can be adapted to accommodate a different number of bottles according to user requirements. Turning to the carton blank 510 illustrated in FIG. 15, this blank includes a first base panel 512, sloping heel panel 514, lower side panel 516, upper side panel 518, shoulder panel 520, top panel 522, second shoulder panel 524, second upper panel 526, second lower side panel 528, sloping heel panel 530, second base panel 532 hingedly connected one to the next in a longitudinal plane along fold lines 534, 536, 538, 540, 542, 544, 546, 548, 550 and 552 respectively. In this embodiment, the side walls can be considered to comprise the sloping heel panels, lower side panels, upper side panel and shoulder panels. In other embodiments, the side wall can comprise one or more of these panels.

For tightening the wrapper or blank around a group of articles, tightening apertures 558 are optionally formed in base panel 512 while a similar tightening aperture 560 may be formed in second base panel 534. With the wrapper disposed about a group of articles and with the base panels 512 and 534 disposed in an overlapping relationship, machine elements enter the tightening apertures 558, 560 and move towards the other, so as to tighten the wrapper about the group of articles as is well known. After the wrapper is tightened, it is locked by means of locking tabs 562 which are driven through the apertures defined by retaining tabs 564 respectively. The configurations of locking tabs and retaining tabs 562, 564 are well known and the locking operation is well understood. Of course other known arrangements for securing the base panels together can be used with the present invention, for example providing glue flaps to secure first and second base panels in overlapping relationship.

There may further comprise article support and retaining means 566 which in this embodiment comprises a series of article engaging reinforcing flaps 568, 570, 572; 574, 576, 578 struck from the respective sloping heel panels 514; 530 and base panels 512; 532. The article support and retaining means further comprises a series of article support panels 580, 582, 584; 586, 588, 590 struck from respective lower side panels 516, 528. Article support panels 580-590 and article engaging reinforcing flaps 568-578 are identical and therefore a detailed description of article support panel 580 and article engaging reinforcing flap 568 only are here included and described in greater detail by reference to FIG. 16. It is envisaged that in some embodiments the reinforcing flaps are not provided, because the displaceable zone, hereinafter described, is sufficient to provide satisfactory article support and retention. Further, the article support panels can be struck from other panels of the carton blank, without departing from the scope of invention.

Thus, in this embodiment, the article engaging reinforcing flaps 568 comprises a pair of oppositely disposed flaps 592, 594 foldably joined to sloping heel panel 514 along fold lines 596 and 598 respectively, shown in FIG. 16. Preferably, fold lines 596 and 598 are convergent in an upward direction. Flaps 592, 594 are also connected to base panel 512 along fold lines 400 and 402 respectively, being convergent towards the free end edge of base panel 512. Preferably, fold lines 596; 598 and 400; 402 intersect at interrupted fold line 534. A cut line 404 separates adjacent flaps 592, 594 and optionally a further pair of fold lines 406, 408 extend between the intersection of fold line 534 with fold lines 400, 596; 402, 598 respectively and cut line 404.

The lower edges of flaps 592, 594 define an edge of tightening aperture 558 and the upper edge of flaps 592, 594 extend into an article heel receiving aperture 410, struck from part of the sloping heel panel 514 and extending into lower side panel 516. In the embodiment illustrated in FIG. 16, the article heel receiving aperture 410 is interrupted by article support panel 580 interconnecting opposed side edges of the interrupted lower side panel 516.

The article support panel 580 comprises a series of cut lines 412, 414 being preferably, shaped to conform to the shape of the article. In this embodiment, the cut lines 412, 414 are arcuate. Thus, each set of cut lines 412 and 414 are spaced on either side of a notional center line extending from points intermediate upper and lower edges 415,416 of the article support panel 580. In this embodiment, each set comprises four cut lines 412 and 414, although it is envisaged that there could be a different number of cut lines to increase or reduce the protrusion or displaceable zone. Thus, articles of varying shapes and sizes can be packaged without departing from the scope of invention, by the addition or removal of cut lines 412, 414. In use, the cut lines 412, 414 define a displaceable zone, hereinafter described.

Turning again to the construction of the blank illustrated in FIG. 15, the blank further comprises a pair of opposed ends closure (or "ad panels") panels 418, 420 hingedly connected to top panel along interrupted fold lines 422 and 424 respectively, positioned along the longitudinal edges of top panel 522. The construction at each end of the top panel and end closure panels 418,420 is similar and therefore like parts at one end of the top panel are designated by reference numerals to like parts of the opposite end with the addition of suffix 'a'. The main portion 426 of end closure panel 418 spans and constitutes one end of the top panel as hinged to an adjacent part thereof along longitudinal fold line 422.

The end closure panel 418 also includes gusset panels 428 and 430 hingedly connected together along fold line 422 and extending outwardly from upper side panel 518 and shoulder panel 520. In this embodiment, gusset panel 428 is connected to shoulder panel 520 along fold line 432 extending from aperture 434 to intersect with fold line 540. As shown in FIG. 15, cut line 436 defines the lower edge of gusset panel 428 extending outwardly from the intersection of fold lines 540 and 432. Gusset panel 430 is connected to main portion 426 by lateral fold line 438. Gusset panel 430 can be separated from main portion 426 by a corner arrangement. By way of example, the corner arrangement comprises a series of panel portions 440, 442 which are hingedly connected together by fold lines 444, 446 and to gusset panel 430 by fold line 438 to define a substantially curved corner.

Likewise, the opposing corner of the end closure panel 418 also includes gusset panels 448 and 450 hingedly connected together along fold line 423 and extending outwardly from upper side panel 526 and shoulder panel 524. In this embodiment, gusset panel 448 is connected to shoulder panel 524 along fold line 452 extending from aperture 454 to intersect with fold line 546. As shown in FIG. 15, cut line 456 defines the lower edge of gusset panel 448 extending outwardly from the intersection of fold lines 546 and 452. Gusset panel 450 is connected to main portion 426 by lateral fold line 458. Gusset panel 450 can be separated from main portion 426 by a corner arrangement. By way of example, the corner arrangement comprises a series of panel portions 460, 462 which are hingedly connected together by fold lines 464, 466 and to gusset panel 450 by fold line 458 to define a substantially curved corner. In other embodiments, gusset panels could be connected to other panels forming the side wall without departing from the scope of invention.

In one class of embodiments, a stabilizing (or bottle neck spacer) flap 468 shown in FIG. 15 is struck from the blank partially in the top panel 522 and partially in the main portion of end closure panel 418 so that the flap 468 is hinged to those panels about fold lines 470, 472 respectively but otherwise cut out from the blank. Flap 468, preferably comprises a tread panel 474 and a riser panel 476, connected together along fold line 478, which panels are adapted during carton construction to define a step (or keel element).

Figure 17A:
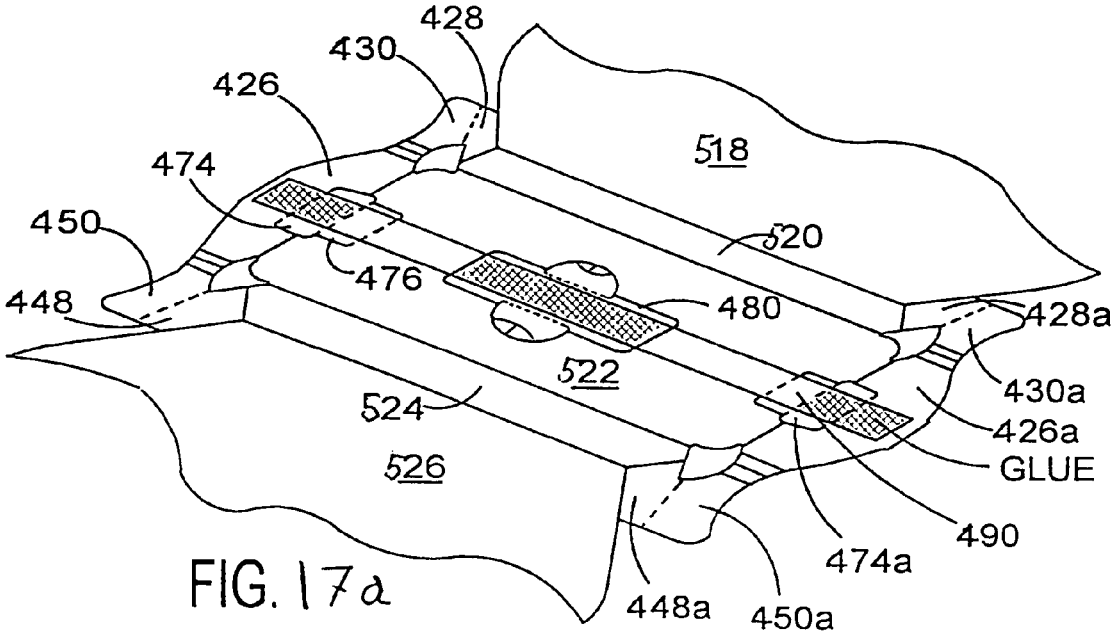
FIG. 17*a* is a perspective view of the upper panels of the blank shown in FIG. 15.

The top panel 522 can further comprise a central user part 480, frangibly connected to the top panel 522. In this embodiment, the central user part 480 is substantially rectangular in shape and comprises a pair of support panels 482, 484 struck from the top panel 522 and connected to the side edges of central user portion along fold lines 486, 488 respectively. Additionally, a handle strap 490, shown in the FIG. 17*a* can be applied to the inner surface of the blank 510, being secured to the central user part 480 and the opposed main portions 426, 426*a* of end closure panels 418, 420 by glue or other means known in the art. Preferably, the handle strap 490 is also glued to the tread panels 474, 474*a* of each step as shown in FIG. 17*a*. It is further preferred the handle strap is formed from paper board, laminated paper board, fibrous tape or other suitable plastics material.

Turning to the construction of the carton, illustrated in FIGS. 17*a*, 17*b*, 18 and 19*a,b,c,d*, the blank requires a series of sequential folding and gluing operations which can be performed in a straight line machine so that the carton is not required to be rotated or inverted to complete its construction. The folding process is not limited to that described below and can be altered according to particular manufacturing requirements.

Thus, articles A are held together in two rows of three articles A and the carton blank is introduced to the articles A. In this embodiment the blank is introduced from above. The shoulder panels 520, 54 and side panels 516, 518, 526, 528 of the blank are then folded about fold lines 542 and 544 respectively such that side panels preferably taper downwardly and outwardly from top panel 522 and the end closure panels are constructed.

The end closure panels 418 and 420 are folded downwardly at each end of the sleeve formed by the wrap around folding action. At the same time, gusset panels 428, 430 and 448, 450 are folded inwardly about fold lines 432, 452 and 422 whereby gusset panels 428;448 come into face to face relationship with shoulder panel 520 and 524 respectively. The panels are at the stage of construction shown in FIG. 17*b*. Thereafter, the side panels 518, 526 continue to be folded such that the second gusset panels 430,450 come into face to face contact with their respective first gusset panels 428, 448. During the aforementioned folding process the corner arrangements are also formed whereby panel portions 440, 460 are folded out of alignment with next adjacent panel portion 442, 462 to define a substantially curved corner portion, shown in FIG. 17*b*.

Optionally, the faces of gusset flaps 428, 448 in contact with shoulder panels 520,524 respectively may be secured together by means known in the art to hold the end closure panels in place. Additionally, or alternatively, first and second gusset panels 428, 430, 448, 450 may be secured together by glue or other means known in the art.

Figure 17B:
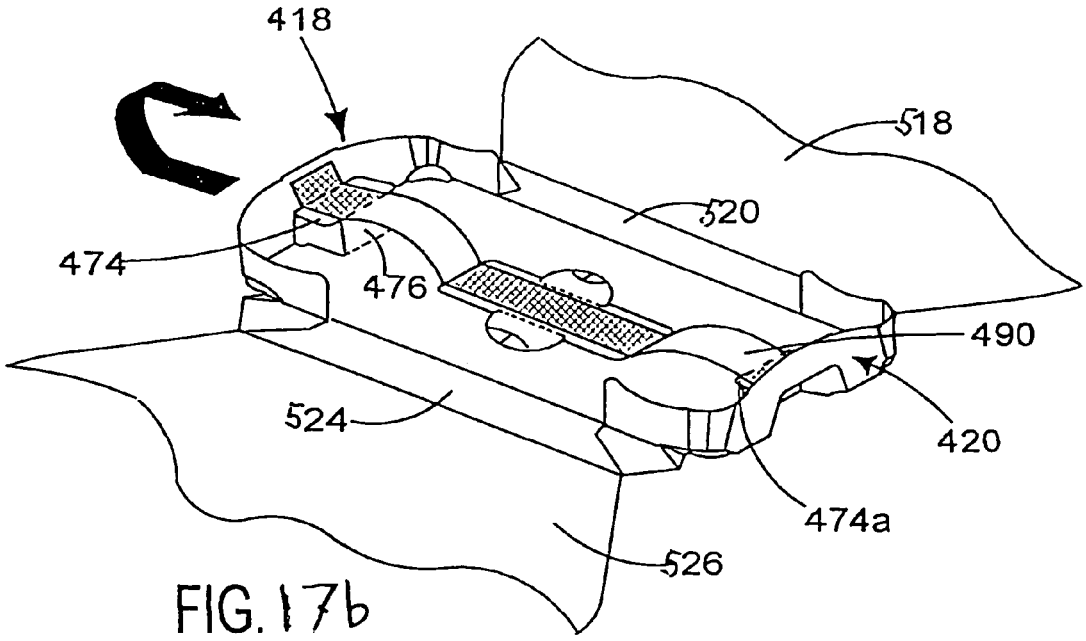
FIG. 17*b* is a perspective view of the inner face of the upper panels of the blank in FIG. 15 showing the end closure panels being formed.

Each of the stabilizing (or bottle neck spacer) flaps 468, 468*a* are formed with cut line 475, 477, 475*a*, 477*a* intermediate and substantially perpendicular to fold lines 470, 472, 470*a*, 472*a* about which flaps can fold in a toggle action to define a step 491 at each end of the top panel 522. This action can occur automatically upon folding the end closure panels which brings the flaps 491 into their operative position in which the flaps are displaced out of the plane of the top panel inwardly of the carton, as shown in FIG. 17*b*. Optionally, cut lines 475, 477;475*a*, 477 are shaped to define a shaped edge adapted to cooperate with a neck portion of an article. Once displaced the, or each, stabilizing flap 468, 468*a* is disposed between neck portions of adjacent end of articles within the package to assist in maintaining the articles in their correct upright positions within the package, particularly to prevent the bottles from toppling inwardly whereas the end closure panels prevent the bottles from toppling end wise of the package.

Figure 18:
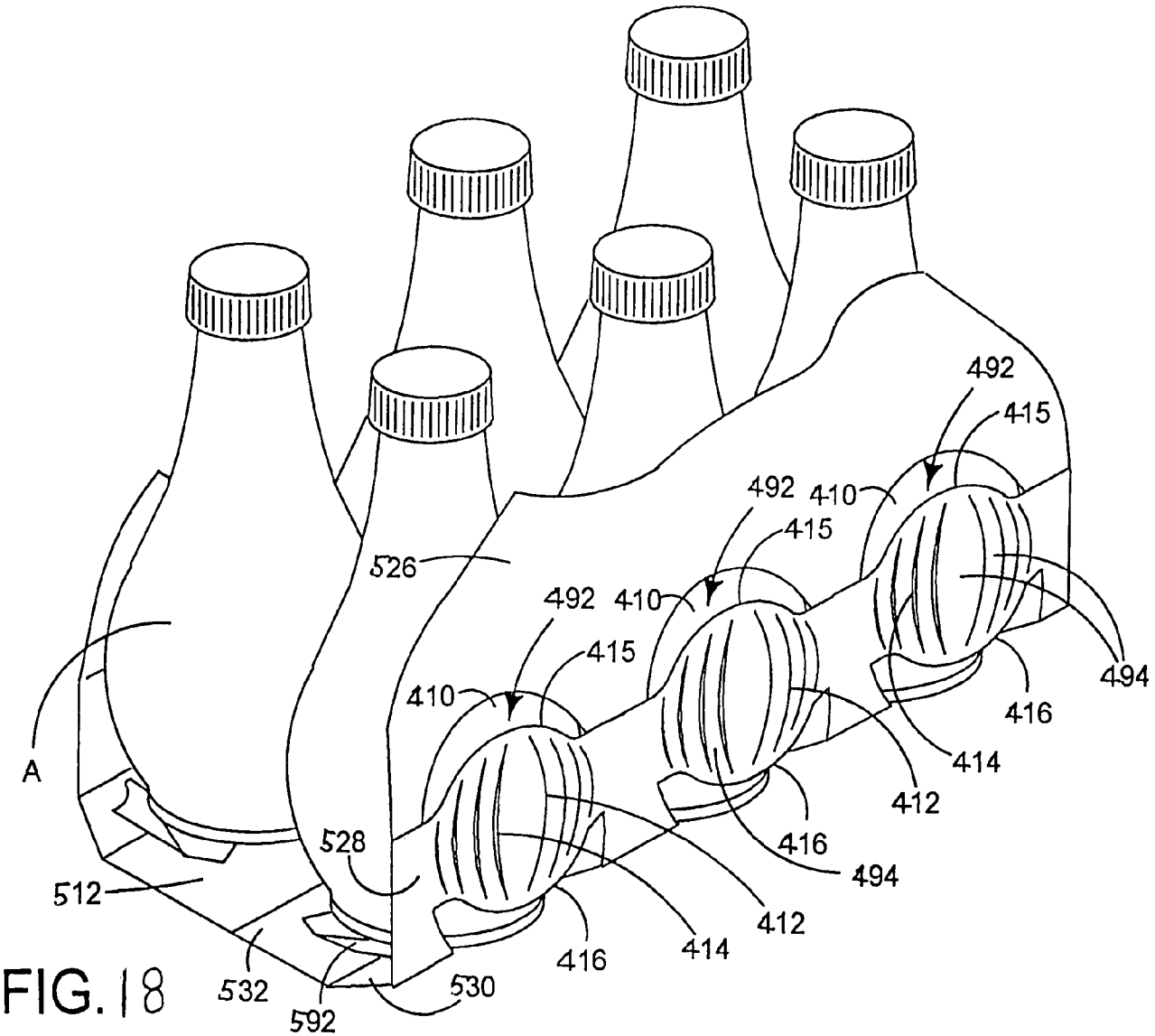
FIG. 18 illustrates the lower portion of the carton formed substantially from the blank illustrated in FIG. 15.
Figure 19A:
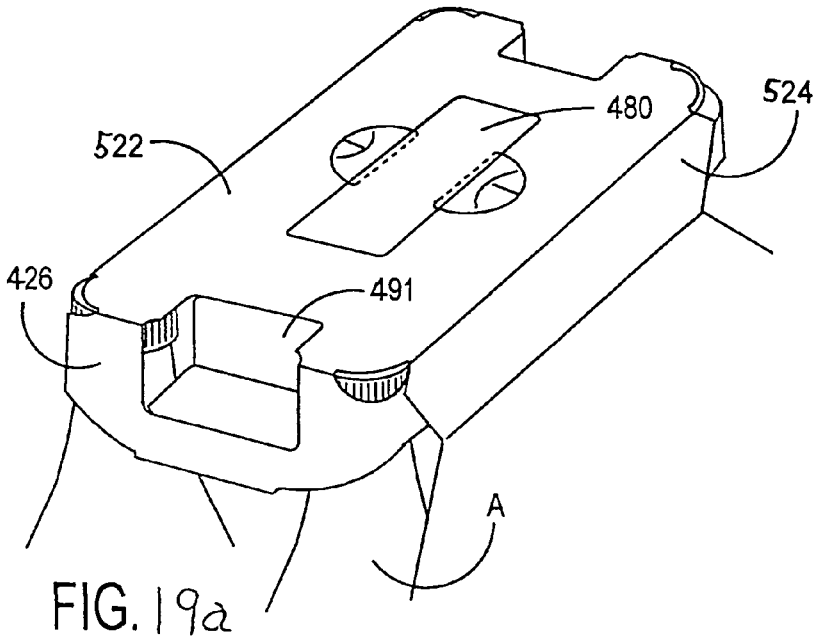
FIGS. 19*a, b, c* and *d* illustrate the upper portion of the carton shown in FIG. 15 showing various views of the handle during its construction.
Figure 19B:
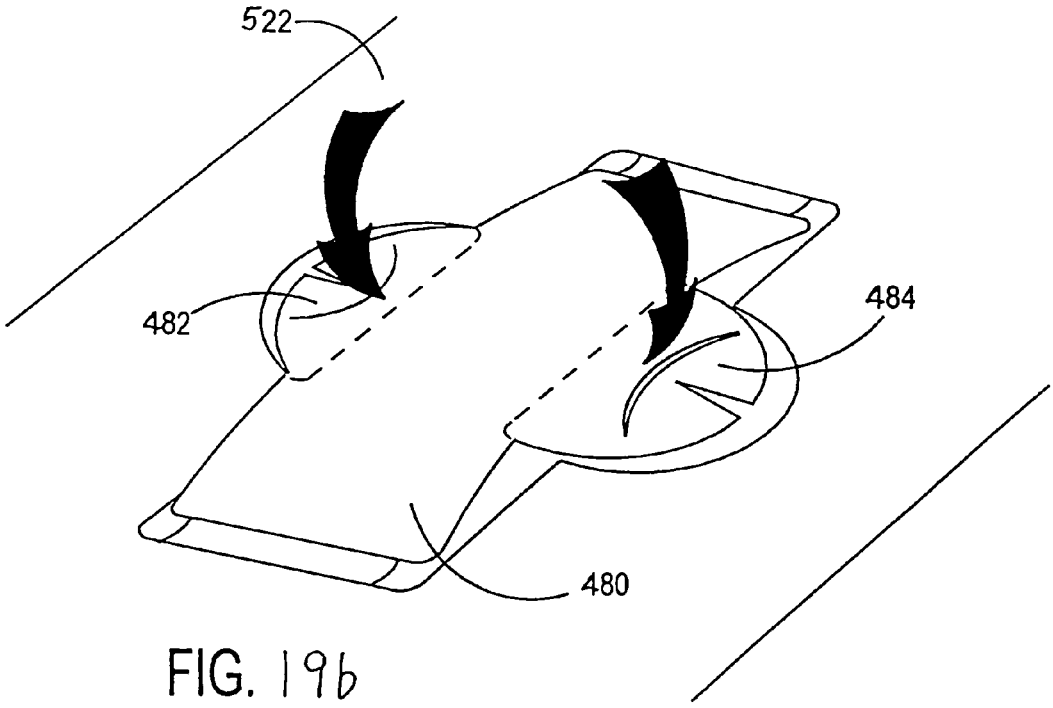
Figure 19C:
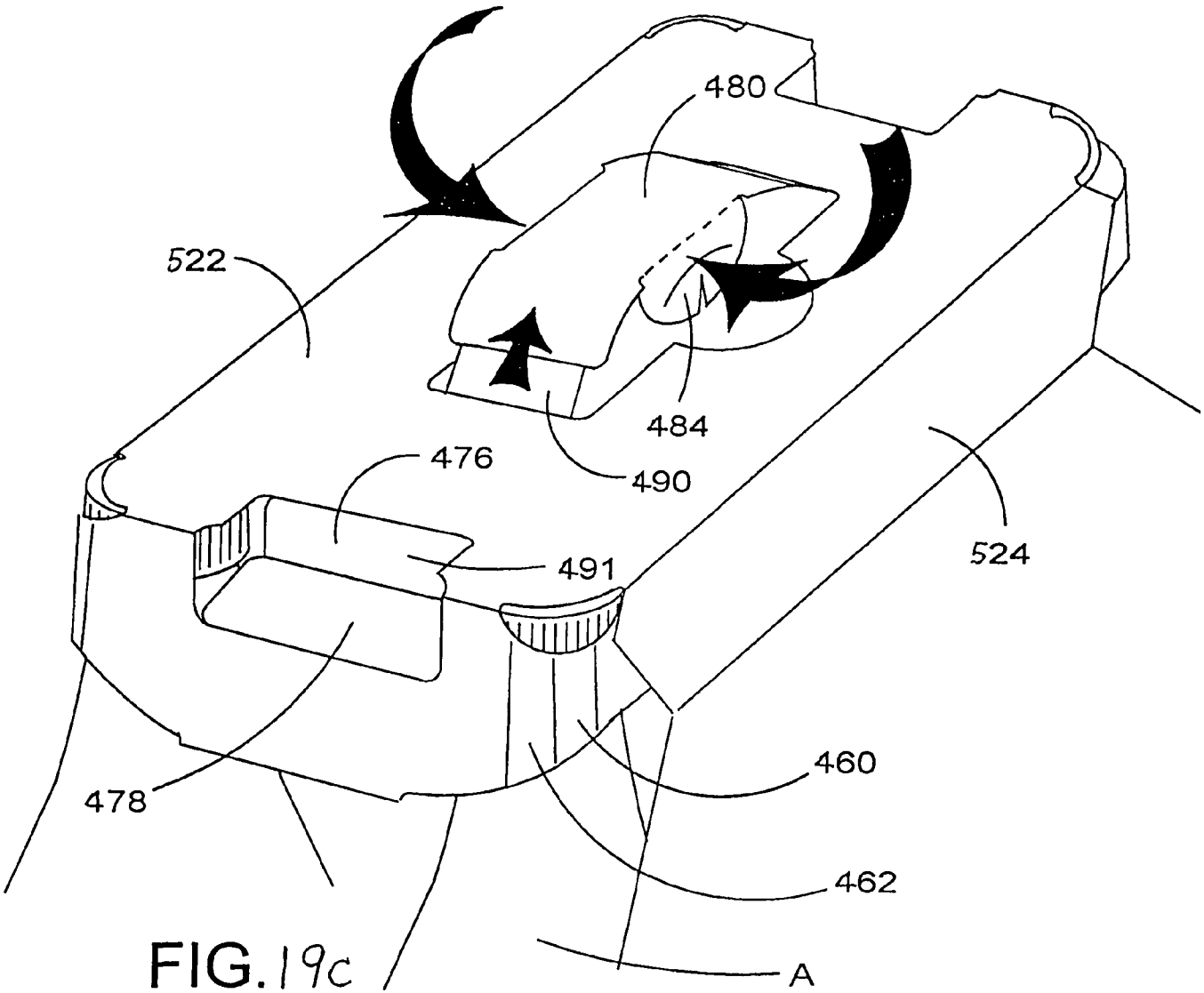
Figure 19D:
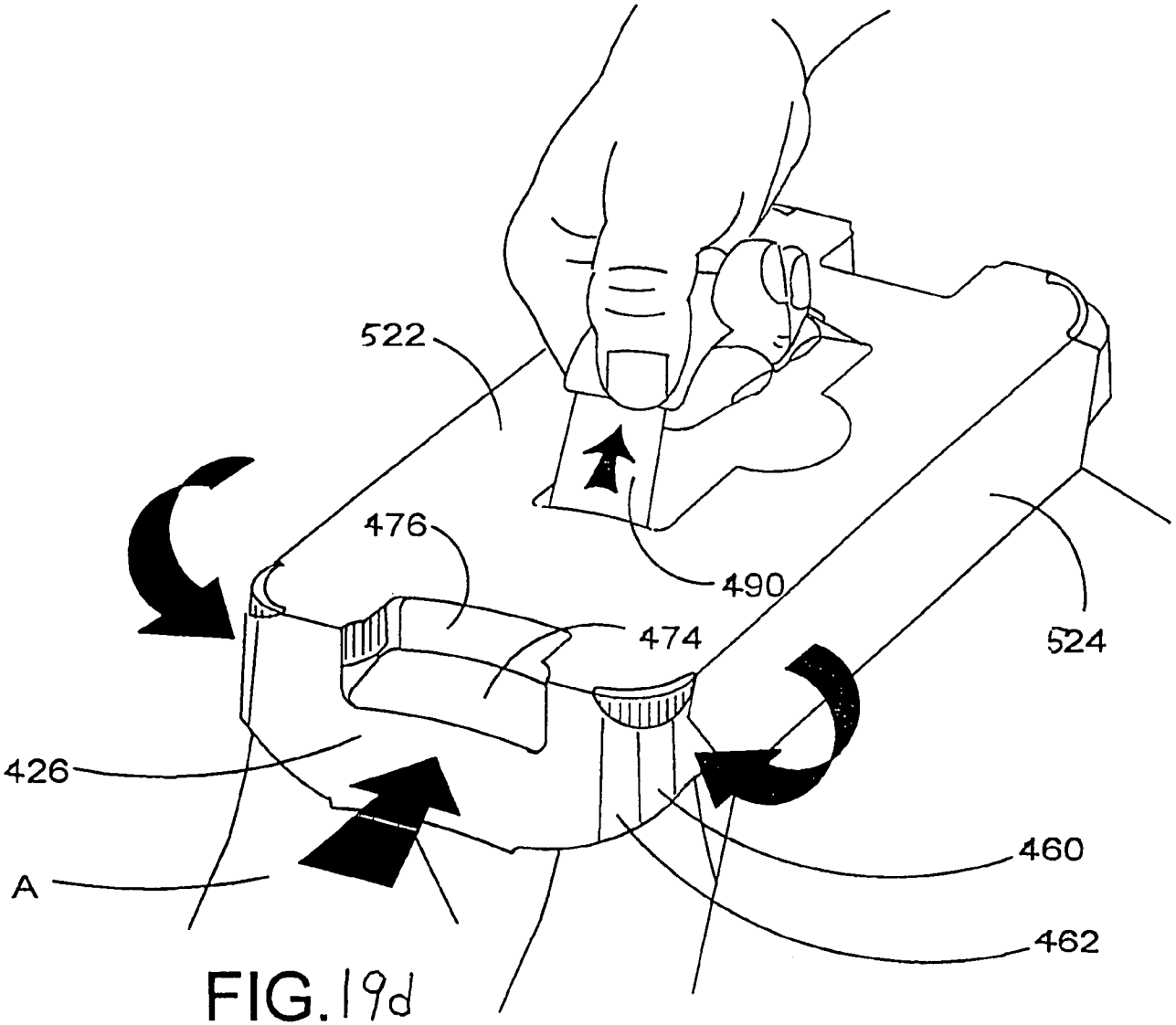

The article support and retaining means 566 is also formed whereby the article engaging flaps 568 to 578 are folded inwardly to define receiving faces as is well known, and base panels 512 and 532 are folded out of alignment with sloping heel panels 514 and 530 and lower side panels 516 and 528 respectively and the side panels and base are brought into contact with respective articles A, such that the lower portion of articles A protrude through apertures formed from the retaining means and are held in position thereto by flaps 592, 594 of retaining means, 566, shown in FIG. 18.

The introduction of articles into the carton causes the articles support panels 580 to 590 to be moved out of alignment with lower side panel upon engagement with a portion of the article whereby a displaceable zone 492 is formed; which displaceable zone, in this embodiment, is arranged to protrude outwardly of the plane of the side walls 516, 528 to accommodate a portion of an adjacent article. It will be seen from FIG. 18, the displaceable zone 492 comprises a multiplicity of connected sections 494 each occupying a different plane to the next adjacent section. More particularly, the edges of the connected sections 494 are defined by the arcuate cut lines 412, 414 as shown in FIGS. 16 and 18.

Thereafter, base panels 512 and 534 are brought into overlapping relationship and connected together as hereinbefore described. Thus, the carton is in a set up and loaded condition shown in part in FIGS. 18 and 19*a*. It will be recognized that rather than the bottom wall being formed from the interlocked panels, the carton blank may be rearranged whereby some other wall such as a top wall or a side wall is formed from the interlocked panels.

The handle is formed by reference to FIGS. 19*a* to 19*d*. The central user part 480 can be detached from the top panel 522 whereby at least a portion of the handle strap can stand proud of the top panel, shown in FIG. 19*b*. It will be seen from FIG. 17*b* that the strap is so connected at the opposite ends of the end closure panels as to provide a surplus of material to enable the central user part 480 to be brought into a position of use, shown in FIG. 19*c*. The support panels 482,484 are folded under the handle strap 490 by the user, such that the central user part 480 is wrapped around the strap, the central user part 480 provides a cushion for the strap, shown in FIG. 19*c*. Further, the central user part 480 is designed for ease of use. When the carton is in use there is a tendency for the handle strap to draw the end closure panels 426, 426*a* and corner arrangements 439, 459 inwardly thereby to improve the integrity of the carton and providing a self tightening effect, shown in FIG. 19*d*. More particularly, the outer articles are supported by the corner arrangement and the stabilizing flaps to minimize article movement in the carton during use.

Advantageously, the preferred embodiments of the present invention illustrate a carton having a strap handle formed from material separate from the blank from which the carton is formed. The handle strap is secured at its opposite ends to the carton and has a user portion exposed to view in a central user aperture or handle access aperture but which is otherwise disposed internally of the carton.

It will be recognized that as used herein, the terms "top", "bottom" and "side" with respect to the panels of the carton (or carton blank) are relative terms, and that the carton (formed from the blank) may be re-oriented as necessary or as desired.

The present invention and its preferred embodiment relate to a carton which is shaped to provide satisfactory strength to hold articles securely but with a degree of flexibility so that load transfer to the handle is absorbed by the carton. The shape of the blank minimizes the amount of paper board required and the carton can be applied to an array of articles by hand or automatic machinery. It is anticipated that the invention can be applied to a variety of cartons and is not limited to the wrap around type or the end-loaded type. For example any of the top panel 522, side panels 520, 524, the end closure panels 418, 420, the stabilizing flap structure or the corner arrangement of the carton of the fourth embodiment can be applied to a top-gripping type carton, and likewise the article retaining and support means 66 can be applied to other carton types, without departing from the scope of the inventions.

What is claimed is:

1. A carton for holding at least an article, comprising top, opposed side walls and a base, hingedly interconnected to form a tubular structure, wherein at least one of said side walls comprises a displaceable zone arranged to protrude outwardly of the carton such that said displaceable zone is disposed out of a plane of said one side wall to accommodate a portion of an article, and wherein said displaceable zone comprises a plurality of connected sections each occupying a different plane to a next adjacent connected section, wherein said displaceable zone further comprises an article support panel struck from a portion of said one side wall, said article support panel being defined by a pair of opposing first and second cut edges and being formed with a plurality of cut lines that define said connected sections, said cut lines being disposed transversely of said first and second cut edges.

2. A carton for holding at least an article, comprising top, opposed side walls and a base, hingedly interconnected to form a tubular structure, wherein at least one of said side walls comprises a displaceable zone arranged to protrude outwardly of the carton such that said displaceble zone is disposed out of a plane of said one side wall to accommodate a portion of an article, and wherein said displaceable zone comprises a plurality of connected sections each occupying a different plane to a next adjacent connected section, said carton further comprising at least one article engaging reinforcing flap folded inwardly of one of said side walls to retain a lower portion of an article.

3. A carton according to claim 2 wherein said connected sections are defined by a series of cut lines, said each connected section being partially separated from said next adjacent section by respective one of said cut lines.

4. A carton according to claim 2 wherein said displaceable zone is shaped to conform to the shape of an article.

5. A blank for forming a carton for holding at least an article each having a shaped body portion, said blank comprising a top, opposed side walls and a base hingedly interconnected together, wherein at least one of said side walls comprises a displacable zone arranged to protrude outwardly of a carton when the blank is erected into the carton and when a portion of an article is accommodated by the displaceable zone, said displaceable zone comprising a plurality of cut lines arranged in a spaced relationship to define a plurality of connected sections, said cut lines being disposed transversely of a pair of opposing free edges of said displaceable zone, wherein said one side wall further comprises at least one article engaging reinforcing flap that is folded inwardly of said one side wall when said blank is erected into a carton.

6. A blank for forming a carton for holding at least an article each having a shaped body portion, said blank comprising a top, opposed side walls and a base hingedly interconnected together, wherein at least one of said side walls comprises a displaceable zone arranged to protrude outwardly of a carton when the blank is erected into the carton and when a portion of an article is accommodated by the displaceable zone, said displaceable zone comprising a plurality of cut lines arranged in a spaced relationship to define a plurality of connected sections, said cut lines being disposed transversely of a pair of opposing free edges of said displaceable zone, wherein said displaceable zone further comprises an article support panel formed from a portion of said one side wall, and wherein said article support panel is defined by said pair of opposing free edges and is formed with said cut lines.

7. A blank according to claim 5 wherein each of said connected sections is partially separated from a next adjacent connected section by respective one of said cut lines.

8. A carton for holding at least an article, comprising top, opposed side walls and a base, hingedly interconnected to form a tubular structure, wherein at least one of said side walls comprises an article support panel arranged to protrude outwardly of the carton such that at least a part of said article support panel is disposed out of a plane of said one side wall to accommodate a portion of an article, and wherein said article support panel is defined by a pair of opposing first and second cut edges and is formed with a plurality of cut lines that define a series of connected sections, said cut lines being disposed transversely of said first and second cut edges.

* * * * *